US012162706B2

(12) United States Patent
Nakata et al.

(10) Patent No.: US 12,162,706 B2
(45) Date of Patent: Dec. 10, 2024

(54) MEDIUM LOADING DEVICE, RECORDING APPARATUS, AND MEDIUM DISCRIMINATION

(71) Applicant: SEIKO EPSON CORPORATION, Tokyo (JP)

(72) Inventors: Satoshi Nakata, Matsumoto (JP); Katsumi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 62 days.

(21) Appl. No.: 17/820,632

(22) Filed: Aug. 18, 2022

(65) Prior Publication Data

US 2023/0059834 A1 Feb. 23, 2023

(51) Int. Cl.
*B65H 1/04* (2006.01)
*B65H 7/14* (2006.01)

(52) U.S. Cl.
CPC ..... *B65H 1/04* (2013.01); *B65H 7/14* (2013.01); *B65H 2405/1122* (2013.01); *B65H 2405/1144* (2013.01); *B65H 2511/11* (2013.01); *B65H 2511/12* (2013.01)

(58) Field of Classification Search
CPC ... B65H 1/04; B65H 7/00; B65H 7/02; B65H 7/14; B65H 2405/112; B65H 2405/1122; B65H 2405/114; B65H 2405/1144; B65H 2511/11; B65H 2511/12; B65H 2511/20; B65H 2511/416; B65H 2553/40; B65H 2553/41; B65H 2553/414
See application file for complete search history.

(56) References Cited

U.S. PATENT DOCUMENTS 5,172,903 A * 12/1992 Haneda ..... B65H 1/266 271/145
5,343,142 A * 8/1994 Sasaki ..... B65H 1/00 324/714
5,689,759 A 11/1997 Isemura et al.
6,267,522 B1 * 7/2001 Slippy ..... B65H 9/04 101/232
6,401,606 B1 * 6/2002 Sato ..... B41L 21/02 101/118

(Continued)

FOREIGN PATENT DOCUMENTS

JP H106-72562 A 3/1994
JP 2005-280994 A 10/2005
JP 2021-001067 A 1/2021

*Primary Examiner* — Prasad V Gokhale
(74) *Attorney, Agent, or Firm* — WORKMAN NYDEGGER

(57) ABSTRACT

A cassette portion includes a side guide, an end guide, and a paper detection portion. The side guide is movable in X direction and controls a motion of a first end portion of paper. The end guide is provided to the side guide to be movable in Y direction, and restricts a motion of a second end portion of the paper. The paper detection portion detects the first restricting position in the X direction of the side guide and a second restricting position in the Y direction of the end guide in a restricted state of the paper. The end guide includes a detection target portion formed such that detection information to be detected by the paper detection portion varies in the Y direction. The paper detection portion detects the first restricting position and the second restricting position by obtaining detection information from the detection target portion.

15 Claims, 16 Drawing Sheets

(56) References Cited

U.S. PATENT DOCUMENTS

| | | | | |
|---|---|---|---|---|
| 2005/0196211 | A1 | 9/2005 | Miki | |
| 2016/0289018 | A1* | 10/2016 | Hyodo | B65H 1/04 |
| 2020/0399081 | A1 | 12/2020 | Nishiyama | |

* cited by examiner

MEDIUM LOADING DEVICE, RECORDING APPARATUS, AND MEDIUM DISCRIMINATION

The present application is based on, and claims priority from JP Application Serial Number 2021-134652, filed Aug. 20, 2021, the disclosure of which is hereby incorporated by reference herein in its entirety.

BACKGROUND

1. Technical Field

The present disclosure relates to a medium loading device, a recording apparatus, and a medium discrimination method.

2. Related Art

A paper feed cassette according to JP-A-2005-280994 includes side fences, an end fence, a first movable member that moves in synchronization with a sliding motion of the side fences, a second movable member that moves in synchronization with a sliding motion of the end fence, and a size detection switch that detects a size of a recording medium.

The size detection switch detects the size of the recording medium by use of a change in pressed state by synthesized convex portions that are formed by overlapping of first convex portions formed on the first movable member and second convex portions formed on the second movable member.

A medium loading device such as the one disclosed in JP-A-2005-280994 has to secure a space for motions of the movable members used for detection of the size of the medium in addition to a space for installing a motion mechanism for a side guide and a space for installing a motion mechanism for an end guide, and is likely to result in an increase in size of the medium loading device.

SUMMARY

According to an aspect of the present disclosure, a medium loading device to load a plurality of media to be transported includes: a side guide configured to move in a width direction intersecting a transport direction of one of the media and to restrict a motion of a first end portion in the width direction of the medium; an end guide provided to the side guide in such a way as to move in the transport direction and to restrict a motion of a second end portion in the transport direction of the medium; and a detection portion that detects a first restricting position in the width direction of the side guide and a second restricting position in the transport direction of the end guide in a restricted state where the side guide and the end guide restrict a motion of the medium, in which the end guide includes a detection target portion formed such that detection information to be detected by the detection portion varies in the transport direction, and the detection portion detects the first restricting position and the second restricting position by obtaining the detection information on the detection target portion.

According to another aspect of the present disclosure, a recording apparatus includes: the medium loading device according to the above-described aspect; a discrimination portion that discriminates, based on a result of detection of the first restricting position and the second restricting position by the detection portion, a type of the medium loaded in the medium loading device; a transporting portion that transports the medium that is discriminated; and a recording portion that performs recording on the medium that is transported.

According to still another aspect of the present disclosure, a medium discrimination method in the medium loading device according to the above-described aspect includes: detecting the first restricting position in the width direction of the side guide; determining whether or not a type of the medium is discriminable based on information on the first restricting position; detecting, when the type of the medium is not discriminable, the second restricting position in the transport direction of the end guide; and discriminating, based on information on the first restricting position only or based on information on the first restricting position and the second restricting position, the type of the medium.

DESCRIPTION OF EXEMPLARY EMBODIMENTS

Figure 1:
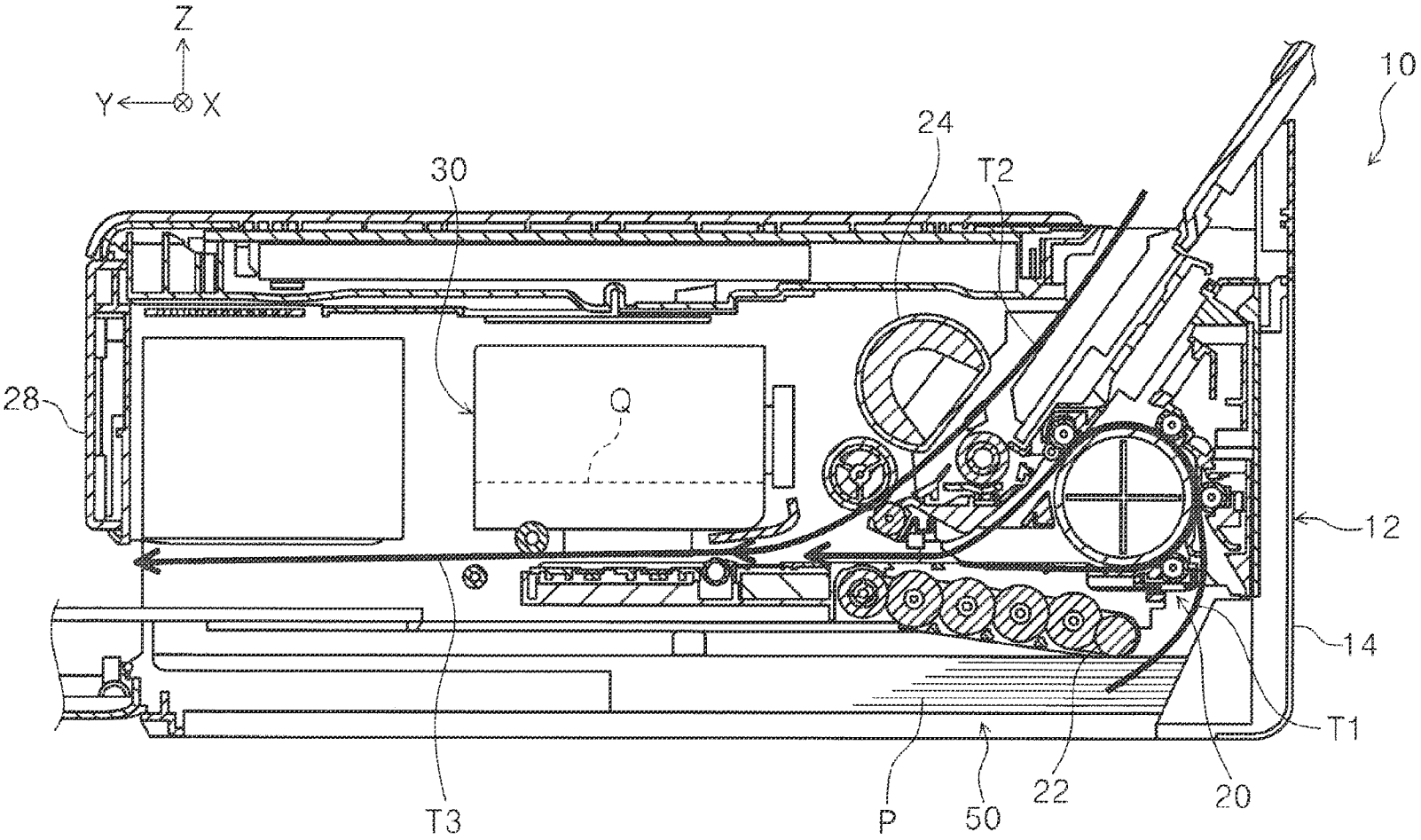
FIG. 1 is a sectional view of a printer according to an Embodiment 1, which is viewed sideways.

The present disclosure will be briefly described below.

A medium loading device according to a first aspect is a medium loading device to load a plurality of media to be transported, the device including: a side guide configured to move in a width direction intersecting a transport direction of one of the media and to restrict a motion of a first end portion in the width direction of the medium; an end guide provided to the side guide in such a way as to move in the transport direction and to restrict a motion of a second end portion in the transport direction of the medium; and a detection portion that detects a first restricting position in the width direction of the side guide and a second restricting position in the transport direction of the end guide in a restricted state where the side guide and the end guide restrict a motion of the medium, in which the end guide includes a detection target portion formed such that detection information to be detected by the detection portion varies in the transport direction, and the detection portion detects the first restricting position and the second restricting position by obtaining the detection information on the detection target portion.

According to this aspect, the end guide is provided to the side guide. This makes it possible to detect the first restricting position in the width direction of the side guide by causing the detection portion to obtain the detection information on the detection target portion of the end guide.

The detection target portion is formed so as to be able to obtain the different the detection information in the transport direction. Accordingly, when the detection portion detects the detection target portion, the detection portion can detect what position in the transport direction the end guide is located. In other words, it is possible to detect the second restricting position in the transport direction of the end guide.

As described above, the detection portion can detect the first restricting position and the second restricting position by detecting the detection target portion, and it is not necessary to secure a space for operating another movable member for detection. As a consequence, it is possible to suppress an increase in size of the medium loading device.

In the first aspect, a medium loading device according to a second aspect is a medium loading device in which the detection portion detects the first restricting position by measuring a distance between the detection portion and the detection target portion.

According to this aspect, the detection portion directly measures the distance between the detection portion and the detection target portion. As a consequence, detection accuracy of the first restricting position is improved.

In the first or second aspect, a medium loading device according to a third aspect is a medium loading device in which the detection target portion includes a plurality of identification portions being arranged in the transport direction and having the detection information different from each other, and the detection portion detects the second restricting position by identifying one of the identification portions.

The configuration in which the detection portion always detect the entire detection target portion has poor detection efficiency because a detection range is too large.

On the other hand, according to this aspect, it is possible to improve the detection efficiency because the detection portion only needs to identify one of the identification portions.

In the third aspect, a medium loading device according to a fourth aspect is a medium loading device in which the detection portion includes an optical sensor provided with a light emitting portion configured to switch between beams of light having different wavelengths and to emit the light toward the identification portions, and a light receiving portion that receives the light reflected from the identification portions, the identification portions have reflectances different from each other, and the detection portion identifies, based on a change in light intensity at the light receiving portion when the light emitting portion switches between the beams of the light having the different wavelengths, a reflectance of one of the identification portions, the reflectance being one of the reflectances different from each other, and detects the second restricting position.

According to this aspect, since the wavelength of the light used by the light emitting portion is known, it is possible to detect the first restricting position based on the magnitude of the light intensity at the light receiving portion. The single identification portion is specified as a consequence of the switching between the beams of light having the different wavelengths by the light emitting portion. This makes it possible to detect the second restricting position. Since it is only necessary to change the reflectances between the identification portions as described above, it is easy to manufacture the identification portions.

In the fourth aspect, a medium loading device according to a fifth aspect is a medium loading device in which colors of the identification portions are different from each other.

According to this aspect, it is possible to identify the identification portions by using the difference in light intensity obtained from the combination of the color of the light used in the light emitting portion with the color of the relevant identification portion. Since it is possible to identify the identification portions based on the difference between the colors of the identification portions, it is not necessary to carry out processing to change values of the surface roughness between the identification portions in order to change the reflectances of the identification portions.

In the third aspect, a medium loading device according to a sixth aspect is a medium loading device in which the detection portion includes an optical sensor provided with a light emitting portion that emits light toward the identification portions, and a light receiving portion that receives the light reflected from the identification portions, and the optical sensor identifies, based on a change in light intensity at the light receiving portion, one of the identification portions, and detects, based on a time period from a point of time to start light emission from the light emitting portion to a point of time to start light reception at the light receiving portion, the first restricting position.

According to this aspect, it is possible to directly measure the distance from the detection portion to the identification portion based on the time period from the point of time to start light emission from the light emitting portion to the point of time to start light reception at the light receiving portion. In this way, the first restricting position can be detected more accurately as compared to a configuration to use a change in light intensity only.

In any one of the first to sixth aspects, a medium loading device according to a seventh aspect is a medium loading device in which a support portion that supports a portion of the end guide is provided to the side guide, and the detection target portion is configured to come into contact in the width direction with the support portion.

According to this aspect, the end guide moves while being in contact with the side guide. That is to say, the end guide can slide. In other words, the medium loading device can be reduced in size in the width direction since it is possible to bring the distance from the end guide to the side guide closer.

In the seventh aspect, a medium loading device according to an eighth aspect is a medium loading device in which the support portion includes a window portion that exposes a portion of the detection target portion toward the detection portion.

According to this aspect, a detection range of the detection target portion is narrowed by the window portion. Thus, it is possible to reduce an error factor included in the detection information.

In any one of the first to eighth aspects, a medium loading device according to a ninth aspect is a medium loading device in which the side guide including: a first side guide that supports the end guide; a second side guide provided on an opposite side of a side on which the detection portion is located relative to the first side guide, and configured to come into contact with the medium; and an interlocking portion that interlocks the first side guide and the second side guide in mutually opposite directions in the width direction.

According to this aspect, the medium is pinched in the width direction by using the first side guide and the second side guide, whereby the medium is positioned in the width direction. In this way, the medium is less likely to be displaced in the width direction as compared to a configuration in which the single side guide restricts only the first end portion on one side in the width direction. As a consequence, the first restricting position can be detected at high accuracy.

A recording apparatus according to a tenth aspect is a recording apparatus including: the medium loading device according to any one of the first to ninth aspects; a discrimination portion that discriminates, based on a result of detection of the first restricting position and the second restricting position by the detection portion, a type of the medium loaded in the medium loading device; a transporting portion that transports the medium that is discriminated; and a recording portion that performs recording on the medium that is transported.

According to this aspect, the recording portion performs recording on the medium discriminated by the discrimination portion. It is therefore possible to avoid recording on the medium of a type not targeted for recording.

In the tenth aspect, a recording apparatus according to an eleventh aspect is a recording apparatus in which the discrimination portion discriminates, based on detection information on the first restricting position, the type of the medium, and when the discrimination portion fails to discriminate the type of the medium based on the detection information on the first restricting position, discriminates, based on detection information on the second restricting position, the type of the medium.

According to this aspect, when it is possible to discriminate the type of the medium based only on the detection information on the first restricting position, the type of the medium is discriminated without using the detection information on the second restricting position. Thus, it is possible to reduce time required for discriminating the type of the medium.

On the other hand, when it is not possible to discriminate the type of the medium based only on the detection information on the first restricting position, the type of the medium can be discriminated by using the detection information on the second restricting position as well.

In the tenth or eleventh aspect, a recording apparatus according to a twelfth aspect further includes: an apparatus body that houses the recording portion, in which the medium loading device includes a storage portion detachably provided to the apparatus body and configured to store the medium, the side guide and the end guide are provided to the storage portion, and the detection portion is provided to the apparatus body.

According to this aspect, the detection portion is provided to the apparatus body and is not moved. In other words, even if the storage portion is frequently attached to or detached from the apparatus body, wearing of a terminal serving as an electrical contact of the detection portion is reduced. In this way, it is possible to reduce deterioration in transmission of the detection information on the first restricting position and the second restricting position.

A medium discrimination method according to a thirteenth aspect is a medium discrimination method in the medium loading device according to any one of the first to ninth aspects, the method including: detecting the first restricting position in the width direction of the side guide; determining whether or not a type of the medium is discriminable based on information on the first restricting position; detecting, when the type of the medium is not discriminable, the second restricting position in the transport direction of the end guide; and discriminating, based on information on the first restricting position only or based on information on the first restricting position and the second restricting position, the type of the medium.

According to this aspect, when it is possible to discriminate the type of the medium based only on the detection information on the first restricting position, the detection of the second restricting position does not have to be carried out. Thus, it is possible to discriminate the type of the medium efficiently.

Embodiment 1

A printer 10 as an example of a recording apparatus according to an Embodiment 1 will be specifically described below.

As shown in FIG. 1, the printer 10 includes a body portion 12 as an example of an apparatus body, a cassette portion 50 that loads paper P, a discrimination portion 40 (FIG. 3) that discriminates a type of the paper P, a transporting portion 20 that transports the discriminated paper P, and a recording portion 30 that performs recording on the transported paper P. The paper P represents an example of a medium.

In each of the drawings, X direction is an example of a width direction of the paper P. A base end side of an arrow indicating the X direction will be defined as −X direction while a tip end side of the arrow indicating the X direction will be defined as +X direction.

Meanwhile, Y direction is an example of a transport direction of the paper P, which is orthogonal to the X direction when viewed in Z direction. A tip end side of an arrow indicating the Y direction will be defined as +Y direction while a base end side of the arrow indicating the Y direction will be defined as −Y direction.

Moreover, Z direction is an example of an apparatus height direction of the printer 10, which is orthogonal to both the X direction and the Y direction. A tip end side of an arrow indicating the Z direction will be defined as +Z direction while a base end side of the arrow indicating the Z direction will be defined as −Z direction. In the following description, the +Z direction may be referred to as upward while the −Z direction may be referred to as downward as appropriate. Note that these directions may be simply referred to as the X direction, the Y direction, and the Z direction when the positive side and the negative side thereof need not be distinguished.

Figure 9:
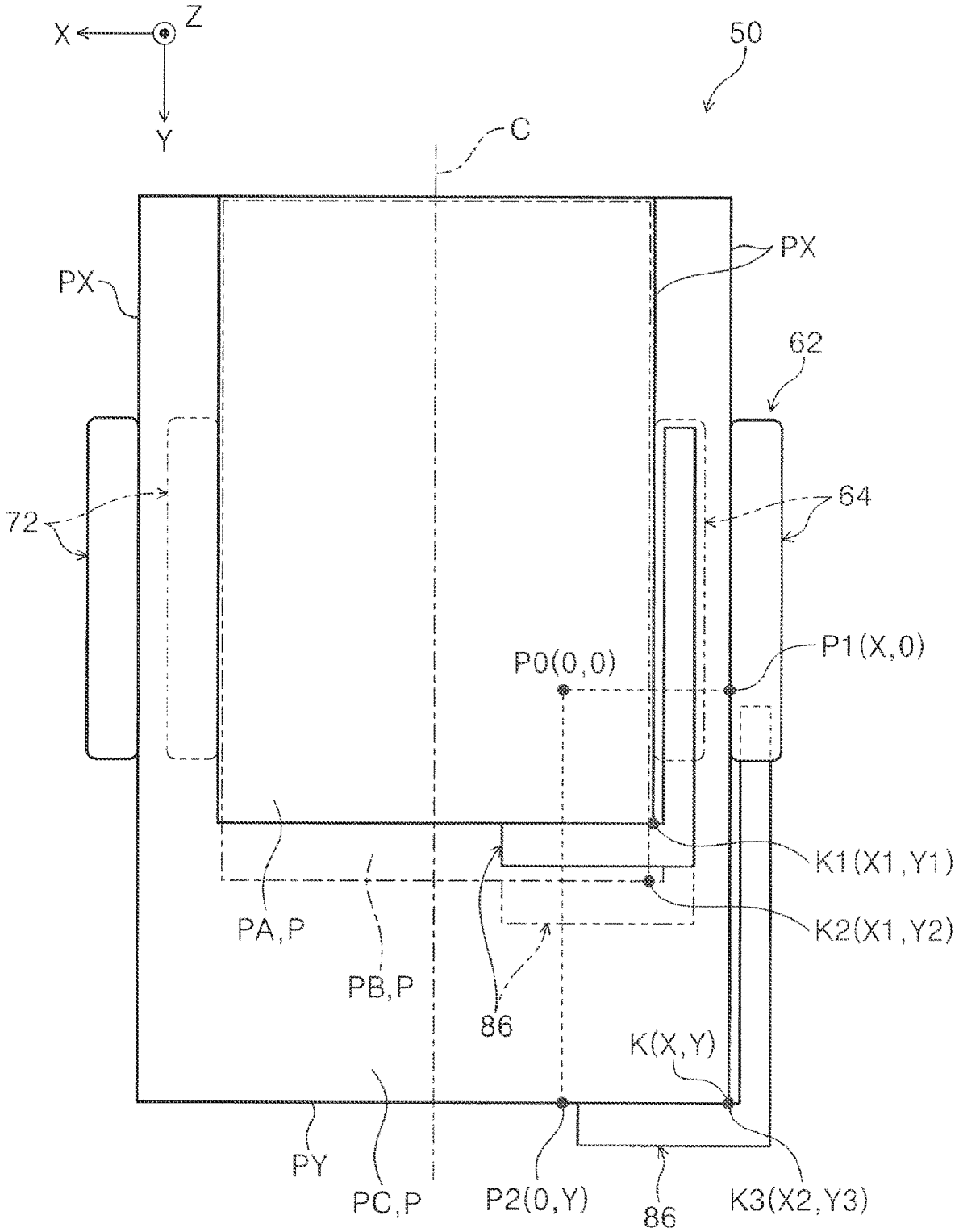
FIG. 9 is a plan view showing a state where paper sheets in different sizes are aligned with one another by using the side guide and the end guide in the printer according to the Embodiment 1.

In the following description, an end portion in the X direction of the paper P will be defined as a first end portion PX (FIG. 9). For example, in this embodiment, each of an end portion in the +X direction of the paper P and an end portion in the −X direction thereof is defined as the first end portion PX. An end portion in the Y direction of the paper P will be defined as a second end portion PY (FIG. 9). For example, in this embodiment, an end portion in the +Y direction of the paper P is defined as the second end portion PY.

Figure 2:
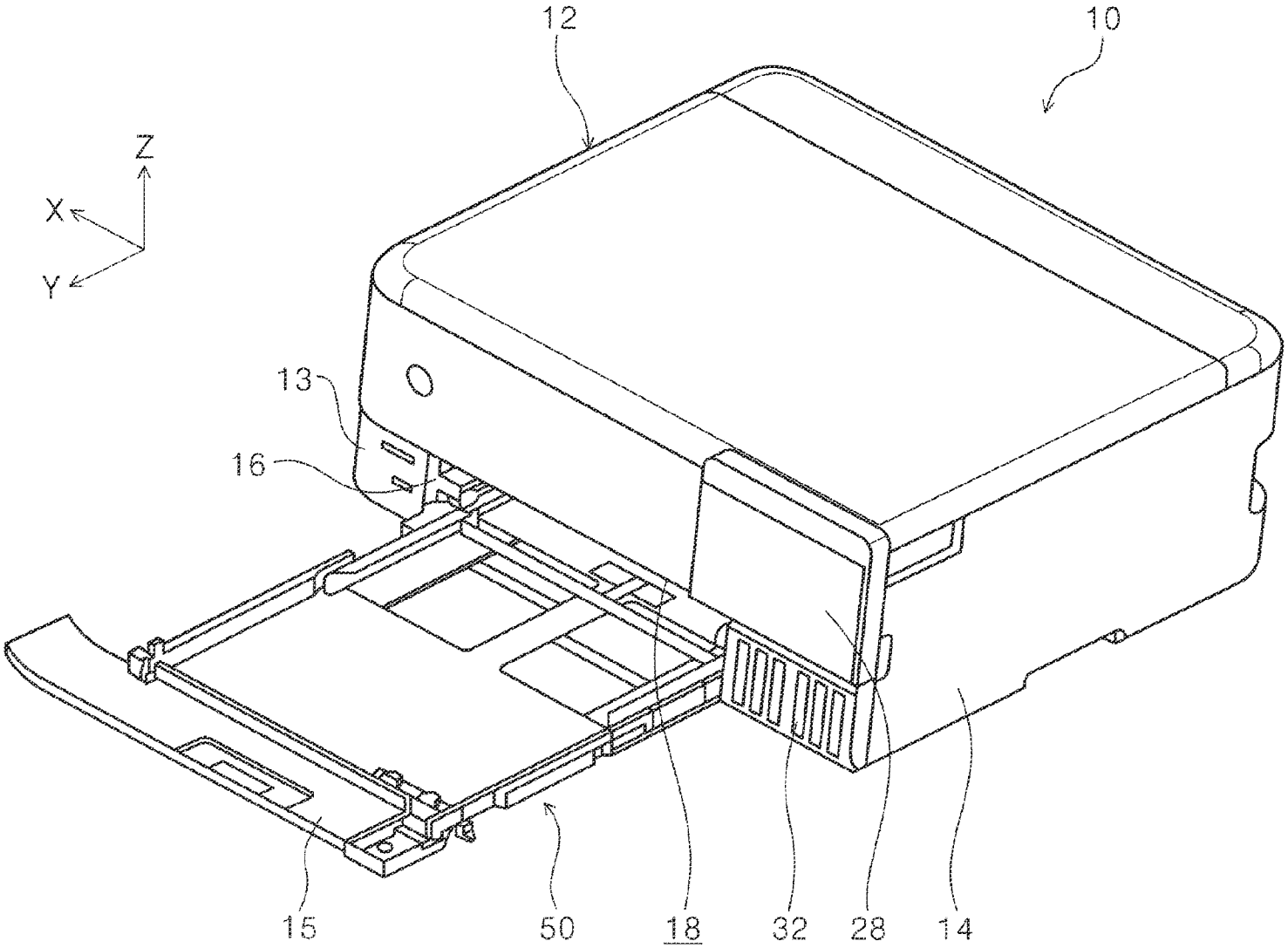
FIG. 2 is a perspective view showing a state of pulling out a cassette portion of the printer according to the Embodiment 1.

As shown in FIG. 2, the body portion 12 includes a housing 14 that constitutes an outer shell of the printer 10, and a body frame 16 provided inside the housing 14. The body portion 12 houses the recording portion 30 (FIG. 1). A space portion 18 to store the cassette portion 50 is formed at a bottom portion 13 located in the −Z direction from the center in the Z direction of the body portion 12.

The housing 14 includes a lower cover 15 that can open and close the space portion 18. The lower cover 15 is turnably joined to an end portion in the +Y direction of the cassette portion 50.

The space portion 18 is opened in the −Z direction and the +Y direction in a state where the cassette portion 50 is detached. The space portion 18 is closed by the lower cover 15 in a state of storage where the cassette portion 50 is attached.

As shown in FIG. 1, the body portion 12 is provided with a first feed route T1, a second feed route T2, and a common route T3, for example.

The first feed route T1 is a route that is directed upward from an end portion in the −Y direction of the cassette portion 50 and is then reversed so as to extend in the +Y direction.

The second feed route T2 is formed by partially opening the housing 14.

The common route T3 is a route to link a downstream end of the first feed route T1 to a downstream end of the second feed route T2, where the paper P is transported from the first feed route T1 or the second feed route T2. The common route T3 is opposed to the recording portion 30 in the Z direction.

The transporting portion 20 includes a pick-up roller 22 that sends the paper P from the cassette portion 50 to the first feed route T1, a feed roller 24 that transports the paper P on the second feed route T2, and a not-illustrated roller driving portion.

An ink Q as an example of a liquid is supplied from an ink tank 32 (FIG. 2) to the recording portion 30. The recording portion 30 includes a recording head of a serial type which performs recording by ejecting the ink to the paper P while moving in the X direction, for example. However, the recording portion 30 may include a line head that performs recording by ejecting the ink to the paper P without moving in the X direction. The recording portion 30 includes not-illustrated nozzles. The recording portion 30 performs the recording on the paper P by ejecting the ink Q from the nozzles to the paper P.

Figure 3:
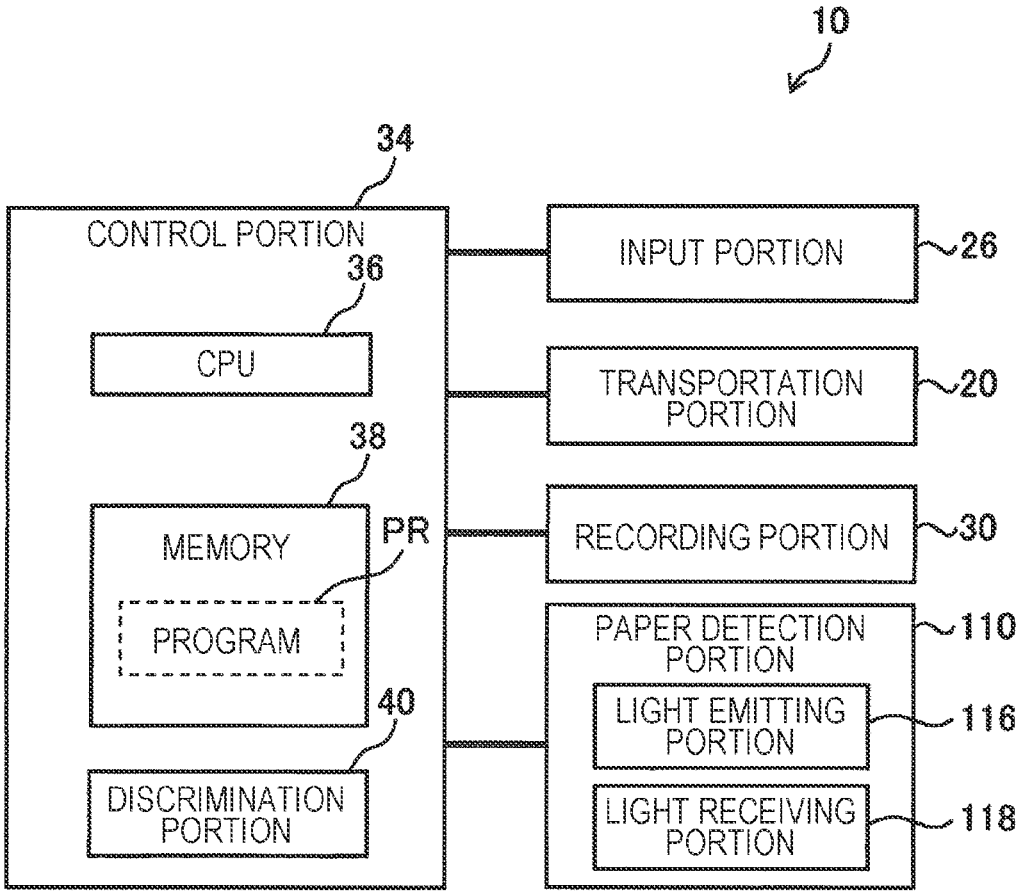
FIG. 3 is a block diagram of the printer according to the Embodiment 1.

As shown in FIG. 3, the printer 10 includes the transporting portion 20, an input portion 26, an operating panel 28 (FIG. 2), the recording portion 30, a control portion 34, and a paper detection portion 110 to be described later.

The input portion 26 includes the operating panel 28. Record information is inputted from the operating panel 28 or a not-illustrated external apparatus such as a personal computer to the input portion 26. The information inputted to the input portion 26 is sent to the control portion 34.

The control portion 34 includes a central processing unit (CPU) 36, a memory 38, a not-illustrated storage section, and the discrimination portion 40, for example.

The control portion 34 controls operations of the respective portions of the printer 10 including the transporting portion 20 and the recording portion 30. The control portion 34 is configured to be capable of receiving information from the input portion 26 and the paper detection portion 110. Details of the discrimination portion 40 will be described later.

Various types of data including a program PR to be executed by the CPU 36 are stored in the memory 38. In other words, the memory 38 represents an example of a storage medium that stores the computer-readable program PR. Other examples of the storage medium include a compact disc (CD), a digital versatile disc (DVD), a Blu-ray disc, a universal serial bus (USB) memory, and so forth. In the meantime, the program PR can be loaded into a portion of the memory 38.

The program PR is a program for discriminating the type of the paper P, which is a program for causing the CPU 36 to execute respective steps to be described later in the printer 10.

Figure 4:
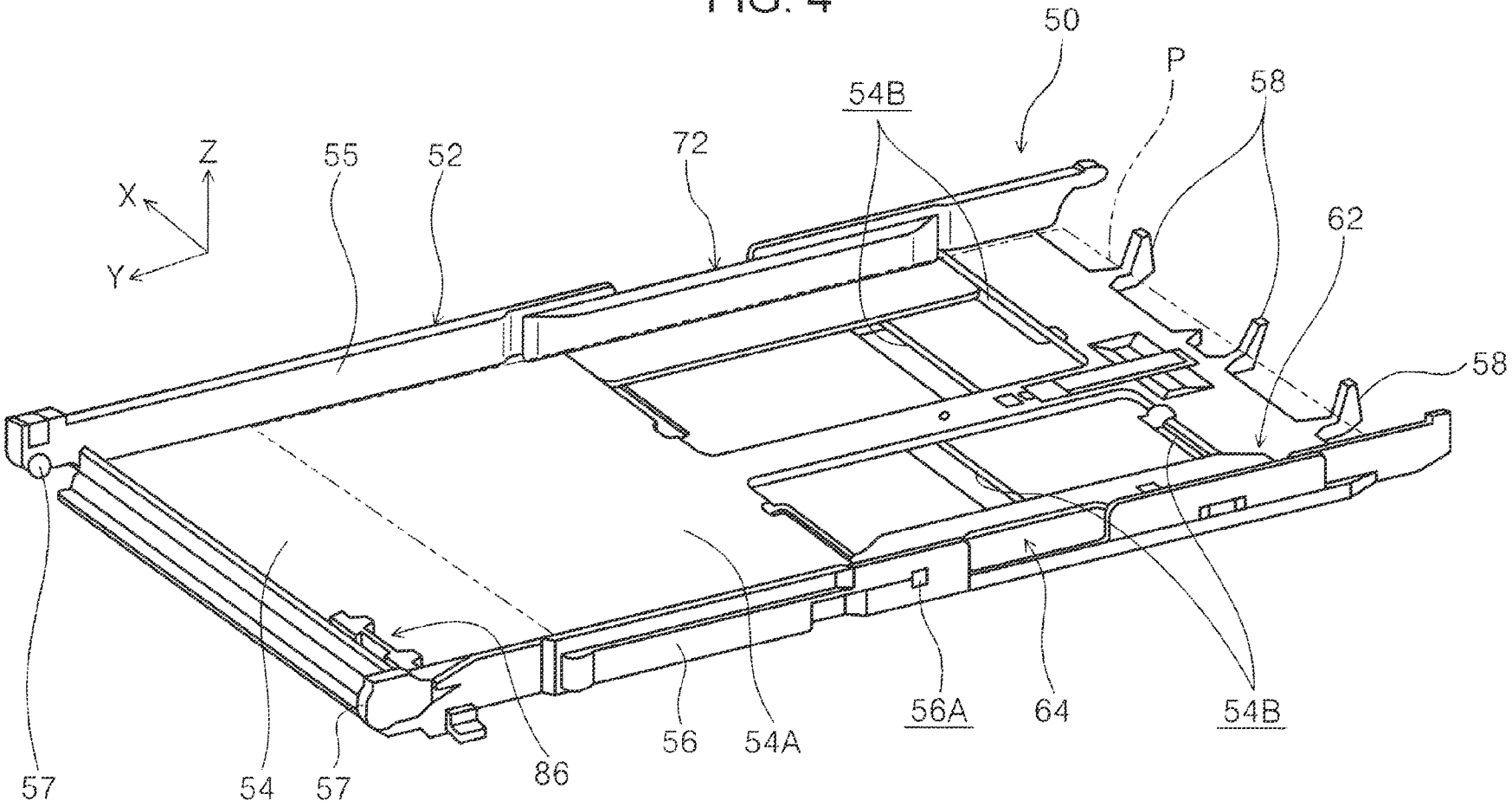
FIG. 4 is a perspective view of the cassette portion of the printer according to the Embodiment 1.

As shown in FIG. 4, the cassette portion 50 represents an example of a medium loading device that loads multiple sheets of the paper P to be transported to the recording portion 30 (FIG. 1). The cassette portion 50 includes a cassette body 52, a side guide 62 which is movable in the X direction, an end guide 86 which is provided to the side guide 62 in such a way as to be movable in the Y direction, and the paper detection portion 110 (FIG. 3) to be described later.

A virtual line that passes through the center in the X direction of the cassette portion 50 and extends in the Y direction is defined as a center line C (FIG. 9). A side located in −X direction relative to the center line C will be referred to as a detection side. A side located in +X direction relative to the center line C will be referred to as a non-detection side.

The cassette body 52 represents an example of a storage portion which is detachably provided to the body portion 12 (FIG. 2) and configured to store the paper P. The cassette body 52 is a component made of a resin, for example. The cassette body 52 includes a bottom wall 54, side walls 55 and 56, a joining portion 57, and alignment portions 58.

The side guide 62 and the end guide 86 to be described later are provided to the cassette body 52.

The bottom wall 54 is a plate region having a predetermined thickness in the Z direction. The bottom wall 54 is formed into a rectangular shape in which a dimension in the Y direction is larger than a dimension in the X direction. An upper surface 54A in the +Z direction of the bottom wall 54 is a mounting surface to mount the paper P. The bottom wall 54 is provided with slits 54B. The slits 54B penetrate the bottom wall 54 in the Z direction and extend in the X direction. The slits 54B guide the side guide 62 in the X direction.

The side wall 55 stands upright in the +Z direction at an end portion in the +X direction of the bottom wall 54.

The side wall 56 stands upright in the +Z direction at an end portion in the −X direction of the bottom wall 54. A hole portion 56A is formed at a region located substantially at the center in the Y direction of the side wall 56.

The hole portion 56A penetrates the side wall 56 in the X direction. The hole portion 56A is formed into a quadrangular shape when viewed in the X direction. The hole portion 56A is formed into such a size that renders a first identification portion 92 and a second identification portion 94 (FIG. 5) to be described later visible when viewed in the X direction.

The joining portion 57 is provided at an end portion in the +Y direction of the bottom wall 54. The lower cover 15 is turnably joined to the joining portion 57.

The alignment portions 58 stand upright in the +Z direction at an end portion in the −Y direction of the bottom wall 54. The alignment portions 58 are provided at intervals in the X direction. The alignment portions 58 come into contact with end portions—in the Y direction of the sheets of the paper P loaded on the upper surface 54A, thereby aligning the end portions in the Z direction.

Figure 5:
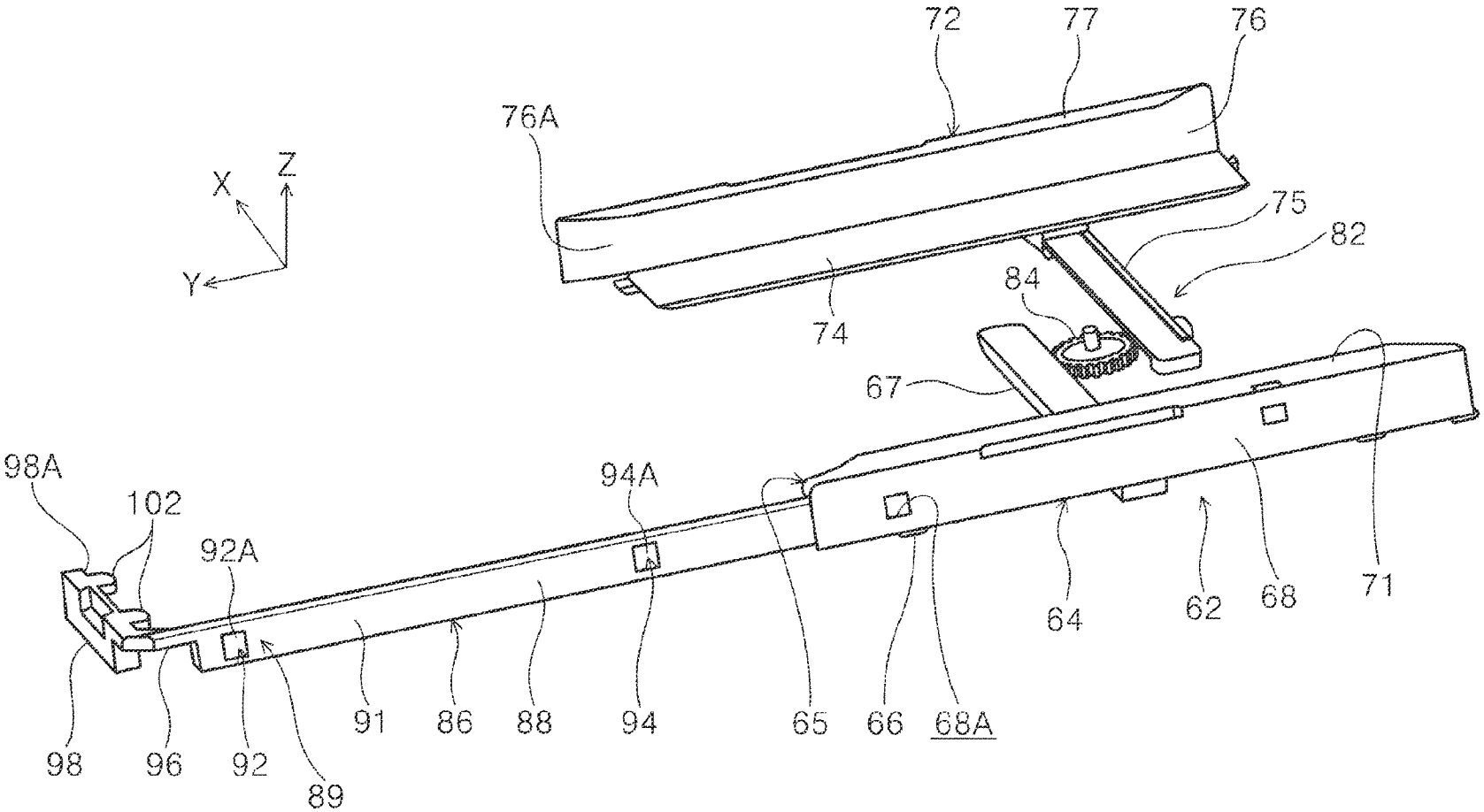
FIG. 5 is a perspective view showing a side guide and an end guide in the printer according to the Embodiment 1.

As shown in FIG. 5, the side guide 62 includes a first side guide 64, a second side guide 72, and an interlocking portion 82. The side guide 62 restricts motions in each of the +X direction and the −X direction of the first end portion PX (FIG. 9) in the X direction of the paper P.

The first side guide 64 supports the end guide 86 in the Z direction. The first side guide 64 is capable of coming into contact with the paper P in the X direction.

The second side guide 72 is provided on the non-detection side being an opposite side of the detection side, on which the paper detection portion 110 (FIG. 3) is located, relative to the first side guide 64. The second side guide 72 is capable of coming into contact with the paper P in the X direction.

The interlocking portion 82 is provided to the cassette body 52 (FIG. 4), and is configured to interlock the first side guide 64 and the second side guide 72 with each other in mutually opposite directions in terms of the X direction.

Figure 6:
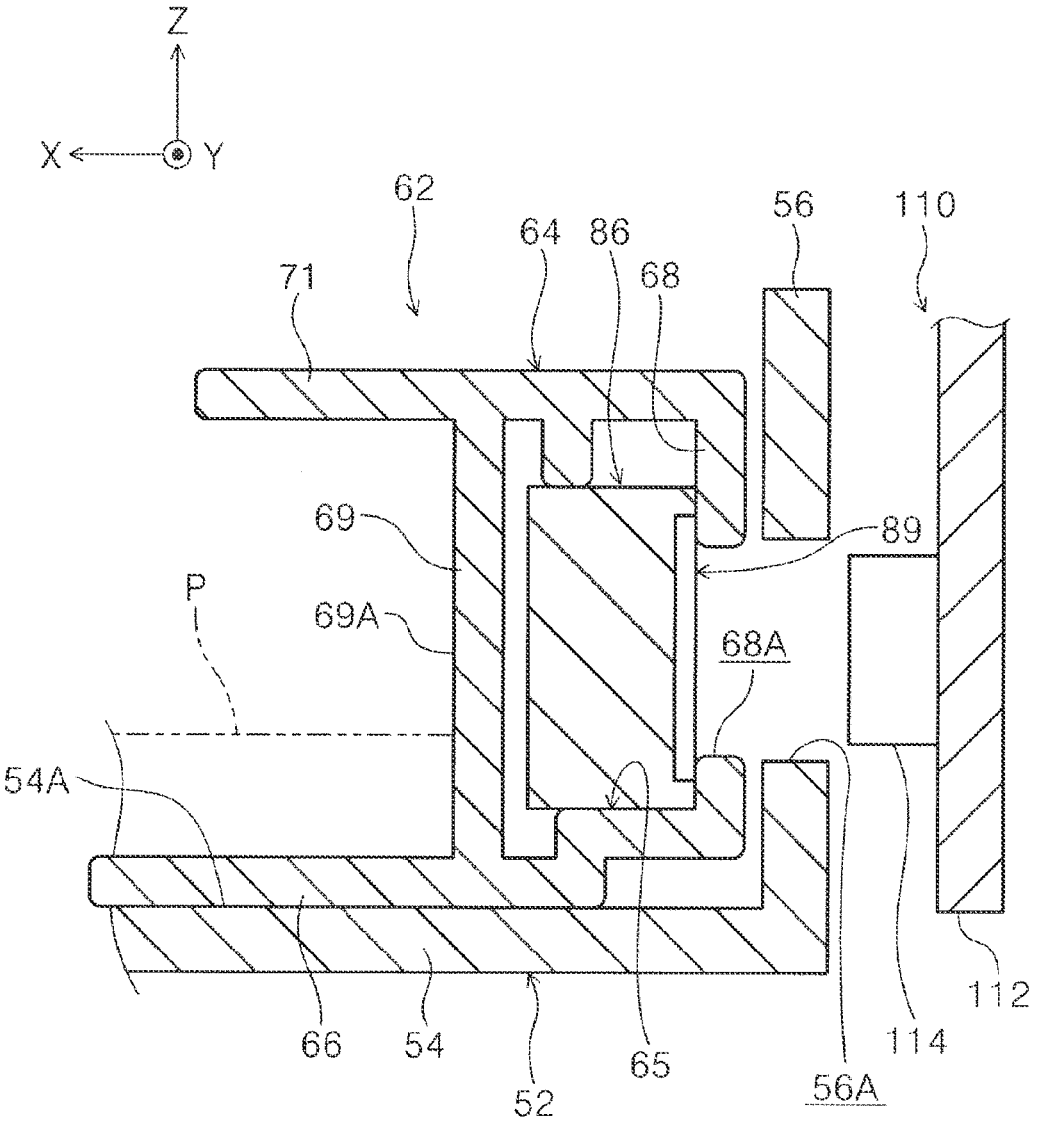
FIG. 6 is a sectional view showing a structure of a detection portion in the printer according to the Embodiment 1.

As shown in FIG. 6, the first side guide 64 is a member that includes a bottom wall portion 66, a rack portion 67 (FIG. 5), an outer wall portion 68, an inner wall portion 69, and an upper wall portion 71, for example. A support portion 65 is formed from the bottom wall portion 66, the outer wall portion 68, the inner wall portion 69, and the upper wall portion 71. In other words, the side guide 62 is provided with the support portion 65 having a quadrangular tube-like sectional shape on x-z plane.

A portion in the Y direction of the end guide 86 is inserted into the support portion 65. The support portion 65 supports the portion in the Y direction of the end guide 86.

The bottom wall portion 66 is formed into a rectangular shape in which a dimension in the Y direction is larger than a dimension in the X direction. The bottom wall portion 66 is placed on the upper surface 54A. An end portion in the −X direction of the paper P is supported by the bottom wall portion 66 in the Z direction.

The rack portion 67 (FIG. 5) is a plate-shaped region that extends in the +X direction from a substantially central portion in the Y direction of the bottom wall portion 66. The rack portion 67 is located below the upper surface 54A. Not-illustrated threads are formed at an end portion in the −Y direction of the rack portion 67.

The outer wall portion 68 is a plate-shaped region that stands upright in the +Z direction at an end portion in the −X direction of the bottom wall portion 66. The outer wall portion 68 is formed into a rectangular shape in which a dimension in the Y direction is larger than a dimension in the Z direction. A window portion 68A is formed at a portion in the +Y direction of the outer wall portion 68 relative to the center in the Y direction thereof. In other words, the window portion 68A is provided to the support portion 65.

The window portion 68A penetrates the outer wall portion 68 in the X direction. The window portion 68A is formed into a quadrangular shape having sides extending in the Y direction and the Z direction when viewed in the X direction. The window portion 68A exposes a portion in the Y direction of a detection target portion 89 to be described later toward the paper detection portion 110. The window portion 68A communicates with the hole portion 56A in the X direction.

The inner wall portion 69 is a plate-shaped region which is located in the +X direction from the outer wall portion 68 and stands upright in the +Z direction from the bottom wall portion 66. The inner wall portion 69 is formed into a rectangular shape in which a dimension in the Y direction is larger than a dimension in the Z direction. A contact surface 69A in the +X direction of the inner wall portion 69 is a contact surface that comes into contact with the paper P.

The upper wall portion 71 is a region which joins an end portion in the +Z direction of the outer wall portion 68 to an end portion in the +Z direction of the inner wall portion 69, and bulges in the +X direction from the end portion in the +Z direction of the inner wall portion 69.

As shown in FIG. 5, the second side guide 72 is a member that includes a bottom wall portion 74, a rack portion 75, a vertical wall portion 76, and an upper wall portion 77, for example. The second side guide 72 is not provided with the support portion 65. The bottom wall portion 74, the vertical wall portion 76, and the upper wall portion 77 have structures which are substantially axisymmetric to the bottom wall portion 66, the outer wall portion 68, and the upper wall portion 71 with respect to the center line C (FIG. 9) except for the window portion 68A. Detailed explanations of the bottom wall portion 74, the vertical wall portion 76, and the upper wall portion 77 will therefore be omitted. Here, a side surface 76A in the −X direction of the vertical wall portion 76 is a contact surface that comes into contact with the paper P.

The rack portion 75 is a plate-shaped region that extends in the −X direction from a region located in the −Y direction from the center in the Y direction of the bottom wall portion 74. The rack portion 75 is located below the upper surface 54A (FIG. 4) and in the −Y direction relative to the rack portion 67. Not-illustrated threads are formed at an end portion in the +Y direction of the rack portion 75.

The interlocking portion 82 is formed from a pinion 84, the rack portion 67, and the rack portion 75, for example. The pinion 84 is disposed below the upper surface 54A, and is made rotatable in a forward direction or a reverse direction around a spindle extending in the Z direction. Some of threads on the pinion 84 are engaged with some of the threads on the rack portion 67 and with some of the threads on the rack portion 75. In this way, the interlocking portion 82 interlocks the motion of the first side guide 64 and the motion of the second side guide 72 in mutually approaching directions or in mutually receding directions.

The end guide 86 includes a vertical wall portion 88, an extending portion 96, a restricting portion 98, and bulging portions 102, for example. The end guide 86 restricts a motion in the +Y direction of the second end portion PY (FIG. 9) in the Y direction of the paper P.

Note that a user manually moves the side guide 62 and the end guide 86 in this embodiment, for example. The interlocking portion 82 may be driven by using a not-illustrated motor.

The vertical wall portion 88 is formed into a plate shape having a predetermined thickness in the X direction, and extends in the Y direction. The vertical wall portion 88 is inserted into the support portion 65. The support portion 65 is provided with a not-illustrated retainer for keeping the vertical wall portion 88 from being displaced in the +X direction. The vertical wall portion 88 can move in the +Y direction and the −Y direction relative to the support portion 65. A length in the Y direction of the vertical wall portion 88 is almost equal to a length in the Y direction of the support portion 65. The detection target portion 89 is formed at an end portion in the −X direction of the vertical wall portion 88.

The detection target portion 89 is formed such that detection information to be detected by the paper detection portion 110 (FIG. 3) varies in terms of the Y direction. The detection target portion 89 is disposed in such a way as to be capable of coming into contact in the +X direction with the support portion 65. The detection target portion 89 includes a base surface 91, the first identification portion 92, and the second identification portion 94, for example. The base surface 91 is formed into a planar shape that extends along y-z plane.

The first identification portion 92 and the second identification portion 94 represent identification portions for which pieces of detection information to be detected by the paper detection portion 110 are different from each other. The first identification portion 92 and the second identification portion 94 are provided in the base surface 91 at an interval in the Y direction.

As described above, the detection target portion 89 includes the first identification portion 92 and the second identification portion 94, which are arranged in the Y direction and provided with the pieces of the detection information being different from each other.

The first identification portion 92 is located at an end portion in the +Y direction of the detection target portion 89, for example. The first identification portion 92 is formed into a thin plate shape having a predetermined thickness in the X direction. A detection target surface 92A is formed at an end portion in the −X direction of the first identification portion 92.

The detection target surface 92A is a plane that extends along the y-z plane. The detection target surface 92A is disposed in such a way as to be flush with the base surface 91, for example. The detection target surface 92A is formed into a quadrangular shape when viewed in the X direction. The detection target surface 92A is larger than the window portion 68A, for example. In other words, when the window portion 68A and the detection target surface 92A are arranged in the X direction, the entire window portion 68A exposes the detection target surface 92A.

A color of the detection target surface 92A is red, for example. A reflectance (JIS Z 8105: 2000) of the detection target surface 92A will be defined as R1. Illustration of the reflectance R1 will be omitted.

The second identification portion 94 is located at a region in the −Y direction of the detection target portion 89 relative the center in the Y direction thereof, for example. The second identification portion 94 is formed into a thin plate shape having a predetermined thickness in the X direction. A detection target surface 94A is formed at an end portion in the −X direction of the second identification portion 94.

The detection target surface 94A is a plane that extends along the y-z plane. The detection target surface 94A is disposed in such a way as to be flush with the base surface 91, for example. The detection target surface 94A is formed into a quadrangular shape when viewed in the X direction. The detection target surface 94A is larger than the window portion 68A, for example. In other words, when the window portion 68A and the detection target surface 94A are arranged in the X direction, the entire window portion 68A exposes the detection target surface 94A.

A color of the detection target surface 94A is white, for example. A reflectance (JIS Z 8105: 2000) of the detection target surface 94A will be defined as R2. Illustration of the reflectance R2 will be omitted.

As described above, the first identification portion 92 and the second identification portion 94 have the reflectances that are different from each other. Specifically, the first identification portion 92 and the second identification portion 94 have the colors that are different from each other. Besides the "color", "surface roughness" is another factor that brings about different reflectances. In this embodiment, however, the surface roughness of the detection target surface 92A has is almost as large as the surface roughness of the detection target surface 94A. Arithmetical mean surface roughness Ra represents an example of the surface roughness (JIS B 0601: 2013).

The extending portion 96 extends in the +Y direction from an end portion in the +Y direction and an end portion in the +Z direction of the vertical wall portion 88. An end portion in the +Y direction of the extending portion 96 is bent in the +X direction. A portion located below the extending portion 96 serves as a space portion for allowing entry of a corner portion of the paper P.

The restricting portion 98 is formed into a rectangular parallelepiped block shape, for example. The restricting portion 98 extends in the +X direction from the end portion in the +Y direction of the extending portion 96. A length in the X direction of the restricting portion 98 is smaller than a length in the X direction of the rack portion 67, for example. A contact surface 98A that comes into contact with the paper P is formed at an end portion in the −Y direction of the restricting portion 98. The contact surface 98A is a plane that extends along x-z plane. The paper P comes into contact with the contact surface 98A, whereby a motion in the +Y direction of the paper P is restricted.

The bulging portions 102 bulge in the −Y direction from an end portion in the +Z direction of the restricting portion 98. Two bulging portions 102 are provided at an interval in the X direction. The bulging portions 102 restrict a motion in the +Z direction or a deformation of the paper P.

Figure 7:
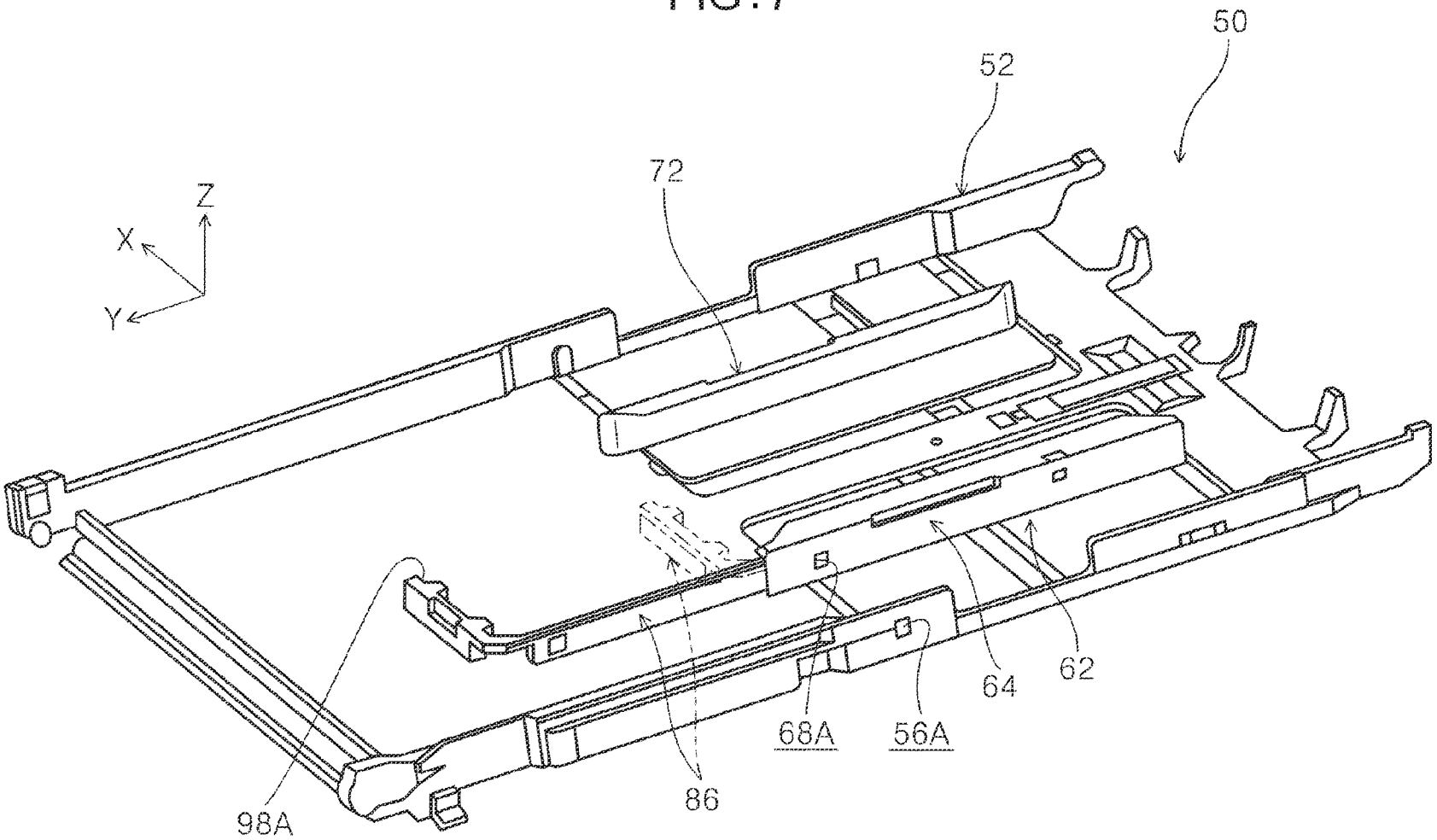
FIG. 7 is a perspective showing a state of moving the side guide and the end guide in the printer according to the Embodiment 1.

As shown in FIG. 7, the first side guide 64 and the second side guide 72 are operated by the user and are caused to interlock with each other by the interlocking portion 82 (FIG. 5), so that the first side guide 64 and the second side guide 72 can move in the mutually approaching directions and the mutually receding directions in terms of the X direction.

The end guide 86 can move in the Y direction by being drawn in the +Y direction or being pushed in the −Y direction by the user. Since the side guide 62 and the end guide 86 are cause to move as described above, it is possible to position the sheets of paper P in different sizes in the cassette portion 50.

Note that an interlocking mechanism portion may be provided in order to interlock the side guide 62 and the end guide 86 with each other such that one of the side guide 62 and end guide 86 moves in accordance with the motion of the other.

Here, a state in which the both the side guide 62 and the end guide 86 in the cassette portion 50 restrict the motion of the paper P will be defined as a restricted state. In the restricted state, a position in the X direction of the first side guide 64 will be defined as a first restricting position P1 while a position in the Y direction of the end guide 86 will be defined as a second restricting position P2.

The first restricting position P1 is expressed as a position in the X direction of the contact surface 69A (FIG. 6) in the restricted state, for example.

The second restricting position P2 is expressed as a position in the Y direction of the contact surface 98A in the restricted state, for example.

Figure 8:
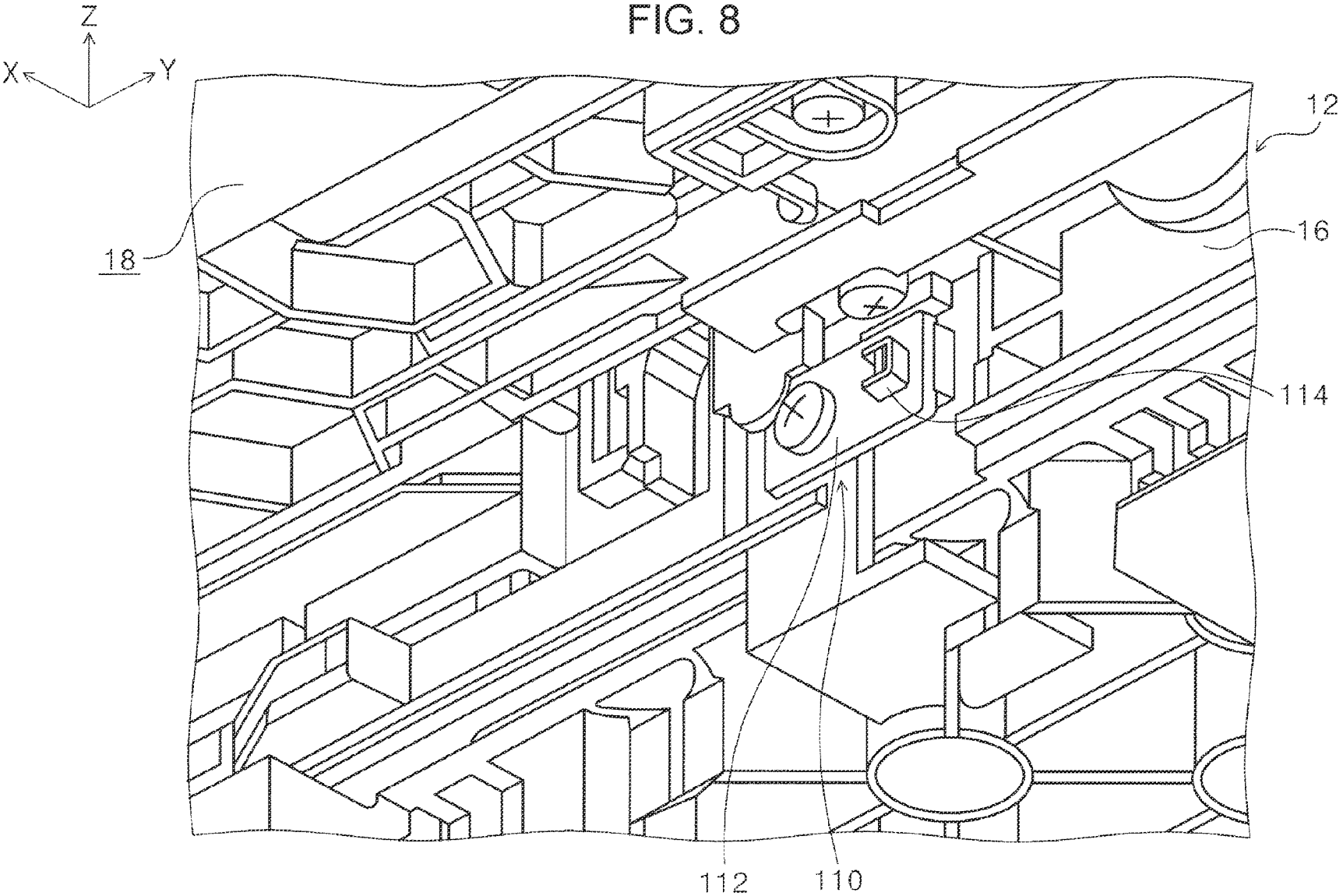
FIG. 8 is a perspective view showing the detection portion provided to the printer according to the Embodiment 1.

As shown in FIG. 8, the paper detection portion 110 is provided to the body frame 16 of the body portion 12 in such a way as to be opposed in the X direction to the window portion 68A (FIG. 5). The paper detection portion 110 represents an example of a detection portion that detects the first restricting position P1 and the second restricting position P2 (FIG. 9) in the above-mentioned restricted state.

The paper detection portion 110 detects the first restricting position P1 and the second restricting position P2 (FIG. 9) by obtaining detection information from the detection target portion 89 (FIG. 5).

Specifically, the paper detection portion 110 detects the first restricting position P1 (FIG. 9) by measuring a distance in the X direction between the paper detection portion 110 and the detection target portion 89. The first restricting position P1 is expressed by the x coordinate on the x-y plane. When a reference position P0 (0, 0) is set on the bottom wall 54 (FIG. 6), the first restricting position P1 is assumed to have coordinates (X, 0).

The paper detection portion 110 detects the second restricting position P2 by identifying one of the first identification portion 92 and the second identification portion 94 (FIG. 5). The second restricting position P2 is expressed by the y coordinate on the x-y plane. The second restricting position P2 is assumed to have coordinates (0, Y) with respect to the reference position P0.

Here, a position of one of corner portions in the +Y direction and the −X direction of the paper P on the x-y plane will be defined as a position K. In the restricted state where the paper P is restricted in the X direction and the Y direction, the position K is defined as (X, Y). The value X and the value Y vary depending on the size representing an example of a type of the paper P to be mounted on the bottom wall 54.

FIG. 9 shows a position K1 corresponding to paper PA, a position K2 corresponding to paper PB, and a position K3 corresponding to paper PC.

As shown in FIG. 6, the paper detection portion 110 includes a substrate 112 provided with a not-illustrated control circuit, and an optical sensor 114.

The optical sensor 114 includes a light emitting portion 116 and a light receiving portion 118 (FIG. 3).

The light emitting portion 116 can switch between beams of light having different wavelengths. The light emitting portion 116 emits light to the first identification portion 92 or the second identification portion 94 (FIG. 5) through the hole portion 56A and the window portion 68A. The light emitting portion 116 is formed from a two-color light emitting diode (LED) that can switch between red light and green light, for example.

The light receiving portion 118 receives a portion of the light emitted from the light emitting portion 116, which is reflected from the first identification portion 92 or the second identification portion 94.

The paper detection portion 110 obtains a light intensity of the light received by the light receiving portion 118 as an example of detection information by the detection target portion 89. Then, the paper detection portion 110 identifies the reflectance of the first identification portion 92 or the second identification portion 94 based on a change in light intensity at the light receiving portion 118 when the light emitting portion 116 switches between the beams of light having the different wavelengths (the red light and the green light). The paper detection portion 110 detects the second restricting position P2.

Here, the paper detection portion 110 transmits information on the first restricting position P1 and the like to the control portion 34 after carrying out necessary processing based on a received light intensity. Instead, the control portion 34 may obtain the first restricting position P1 and the like based on a signal received from the paper detection portion 110.

Figure 10:
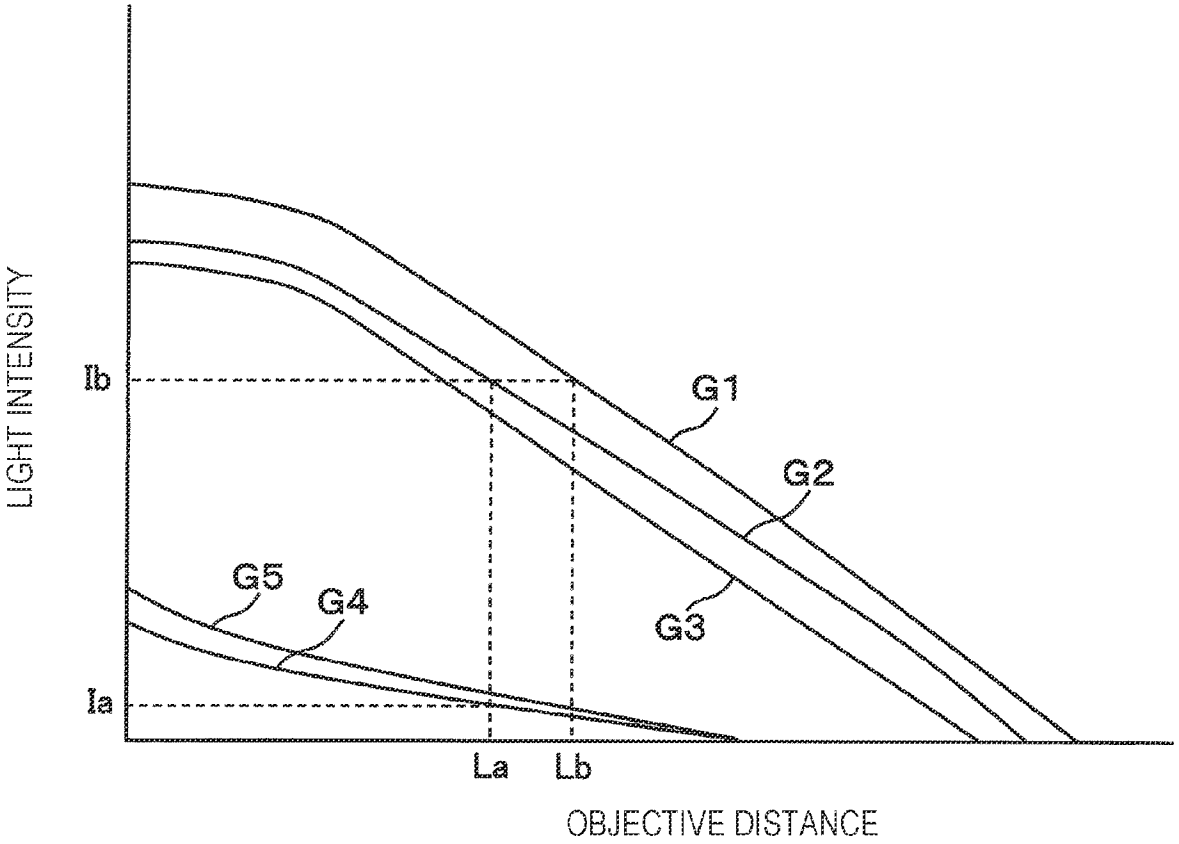
FIG. 10 is a graph showing a relation between an objective distance and a light intensity in a case of changing a combination of a color of light at the detection portion and a color of an identification portion in the printer according to the Embodiment 1.

FIG. 10 plots graphs G1 to G5 each concerning a relation between an objective distance [mm] from the light emitting portion 116 (FIG. 3) to an opposed surface to be irradiated with the light and the light intensity of the light received by the light receiving portion 118 (FIG. 3). Here, the graph G4 and the graph G5 actually reflect the light intensity of almost the same level. However, a difference between the graph G4 and the graph G5 is slightly exaggerated so as to be clearly distinguishable from each other.

The graph G1 represents a case where the color of the emitted light is red and the color of the opposed surface is white. When the opposed surface is white, the light intensity is increased by reflection.

The graph G2 represents a case where the color of the emitted light is red and the color of the opposed surface is red. The light intensity is lower than that in the case of the graph G1.

The graph G3 represents a case where the color of the emitted light is green and the color of the opposed surface is green. The light intensity is lower than that in the case of the graph G2.

The graph G4 represents a case where the color of the emitted light is green and the color of the opposed surface is red. Since red is the complement of green, the reflectance is decreased by light absorption and the light intensity is reduced as a consequence.

The graph G5 represents a case where the color of the emitted light is red and the color of the opposed surface is green. Since green is the complement of red, the reflectance is decreased by light absorption and the light intensity is reduced as a consequence.

For example, when the light emitting portion 116 (FIG. 3) emits the red light and the light receiving portion 118 (FIG. 3) obtains a light intensity Ib, the objective distance will be any one of values La and Lb based on the graph G1 and the graph G2. Here, when the light emitting portion 116 emits the green light and the obtained light has a light intensity Ia, the objective distance is determined to have the value La. Alternatively, the objective distance is determined to have the value Lb when the obtained light intensity has a value other than Ia.

As described above, the objective distance is determined by measuring the light intensity while changing the color of the light emitted from the light emitting portion 116. In other words, the distance from the paper detection portion 110 to the first side guide 64, namely, the first restricting position P1 is thus detected.

This detection result also brings about detection as to whether the color of the opposed surface is white or red. Specifically, the light intensity obtained when the light emitting portion 116 emits the red light is assumed to have the value Ib as mentioned above. Here, in a case in which the light intensity obtained when the light emitting portion 116 emits the green light has the value Ia, the color of the opposed surface is detected to be red. Meanwhile, in a case in which the light intensity obtained when the light emitting portion 116 emits the green light has a value other than the value Ia, the color of the opposed surface is detected to be white. In other words, the identification of the reflectance of the opposed surface clarifies whether it is the first identification portion 92 or the second identification portion 94 which is used for detection. Thus, the second restricting position P2 is detected as a consequence.

As shown in FIG. 3, the control portion 34 includes the discrimination portion 40.

The discrimination portion 40 discriminates the type of the paper P loaded in the cassette portion 50 based on the result of detection of the first restricting position P1 and the second restricting position P2 in the paper detection portion 110. In the meantime, the discrimination portion 40 discriminates the type of the paper P based on the detection information on the first restricting position P1, and discriminates the type of the paper P based on the detection information on the second restricting position P2 when it is not possible to discriminate the type of the paper P based on the detection information on the first restricting position P1. In other words, the discrimination portion 40 does not use the detection information on the second restricting position P2 when it is possible to discriminate the type of the paper P based on the detection information on the first restricting position P1.

In this embodiment, the type of the paper P represents a size of the paper P. Here, when the size of the paper P is associated with a basis weight thereof or when the size of the paper P is associated with a quality thereof in advance, then it is possible to detect the basis weight and the quality as other examples of the type of the paper P.

FIG. 9 illustrates the restricted state, or in other words, a positioned state, where the sheets of paper PA, PB, and PC having different sizes out of the paper P stored in the cassette portion 50 are restricted by the side guide 62 and the end guide 86. The paper PB has a larger area than that of the paper PA. The paper PC has a larger area than that of the paper PB.

Here, the following description will be given by using the reference position P0, the first restricting position P1 (X, 0), the second restricting position P2 (0, Y), and the position K (X, Y) as mentioned earlier.

A position K1 (X1, Y1) is defined in the restricted state of the paper PA.

A position K2 (X1, Y2) is defined in the restricted state of the paper PB.

Here, both of the paper PA and the paper PB have the distance in the X direction equivalent to the value X1. However, FIG. 9 illustrates a width in the X direction of the paper PA and a width in the X direction of the paper PB differently from each other so as to enable discrimination between the paper PA and the paper PB.

A position K3 (X2, Y3) is defined in the restricted state of the paper PC.

In this embodiment, the paper P usable therein includes three types of the paper PA, the paper PB, and the paper PC. In the case of the coordinates (X2, 0) of the first restricting position P1 detected by the paper detection portion 110 (FIG. 3), the corresponding paper P includes the paper PC only. Accordingly, it is possible to discriminate the paper PC without detecting the second restricting position P2.

On the other hand, in the case of the coordinates (X1, 0) of the first restricting position P1 detected by the paper detection portion 110 (FIG. 3), the corresponding paper P includes two type of the paper PA and the paper PB. Accordingly, it is possible to discriminate the paper PA or the paper PB by detecting the second restricting position P2.

Figure 11:
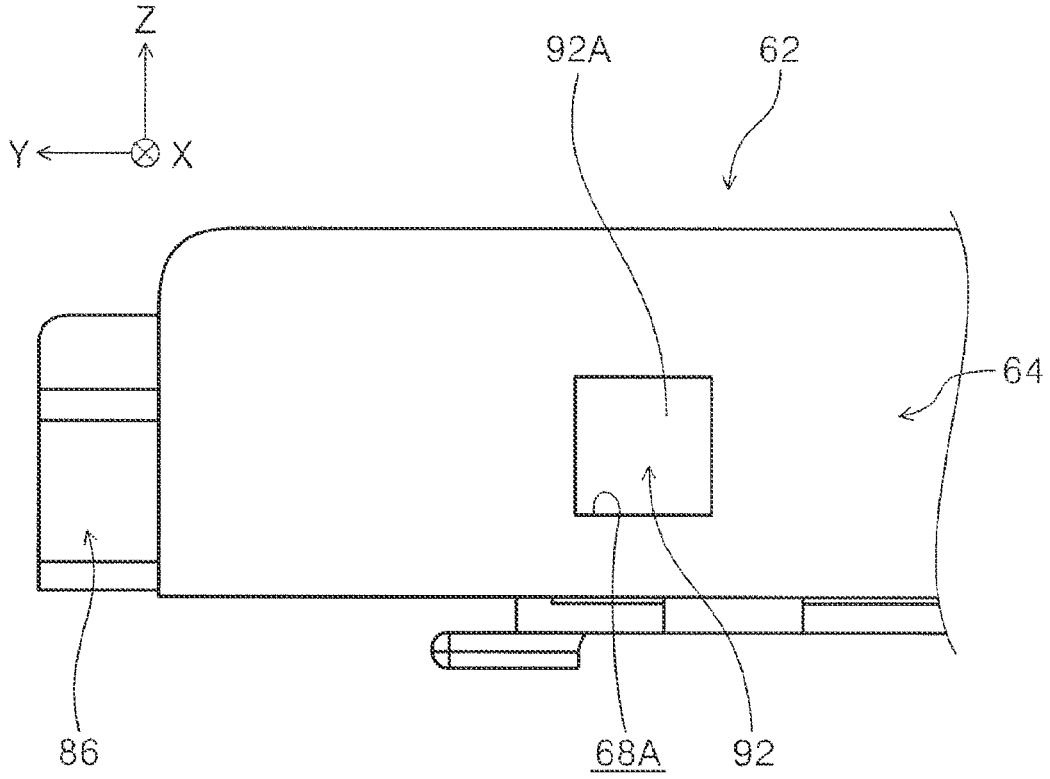
FIG. 11 is a side view showing a state of exposure of a first identification portion from a window portion of the side guide in the printer according to the Embodiment 1.

As shown in FIG. 11, when the first identification portion 92 is exposed to the window portion 68A, the paper detection portion 110 (FIG. 3) changes the color of the emitted light and measures the light intensity, thereby detecting the first restricting position P1 and the second restricting position P2. In this way, the discrimination portion 40 (FIG. 3) discriminates the size of the paper P corresponding to the first identification portion 92.

Figure 12:
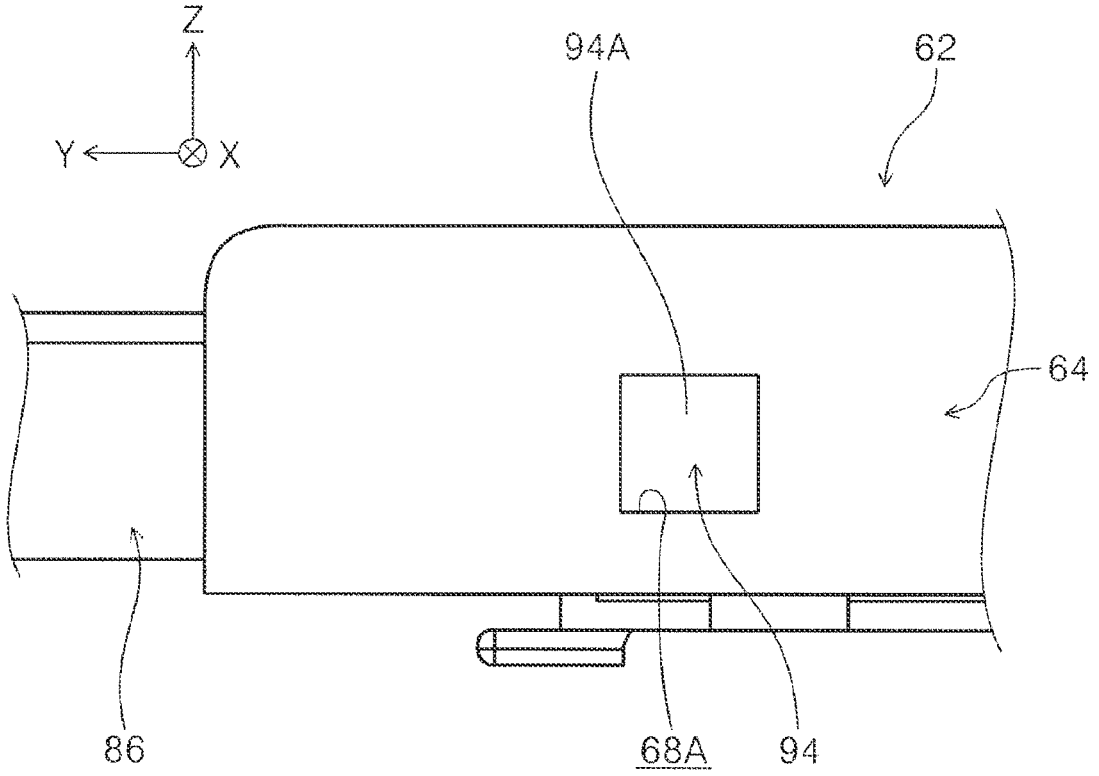
FIG. 12 is a side view showing a state of exposure of a second identification portion from the window portion of the side guide in the printer according to the Embodiment 1.

As shown in FIG. 12, when the second identification portion 94 is exposed to the window portion 68A, the paper detection portion 110 changes the color of the emitted light and measures the light intensity, thereby detecting the first restricting position P1 and the second restricting position P2. In this way, the discrimination portion 40 discriminates the size of the paper P corresponding to the second identification portion 94.

Next, a description will be given of operations of the printer 10 and the cassette portion 50. Here, reference is made to FIGS. 1 to 12 regarding configurations of and reference signs related to the printer 10 and the cassette portion 50, and indications of the respective drawings will be omitted in the following.

Figure 13:
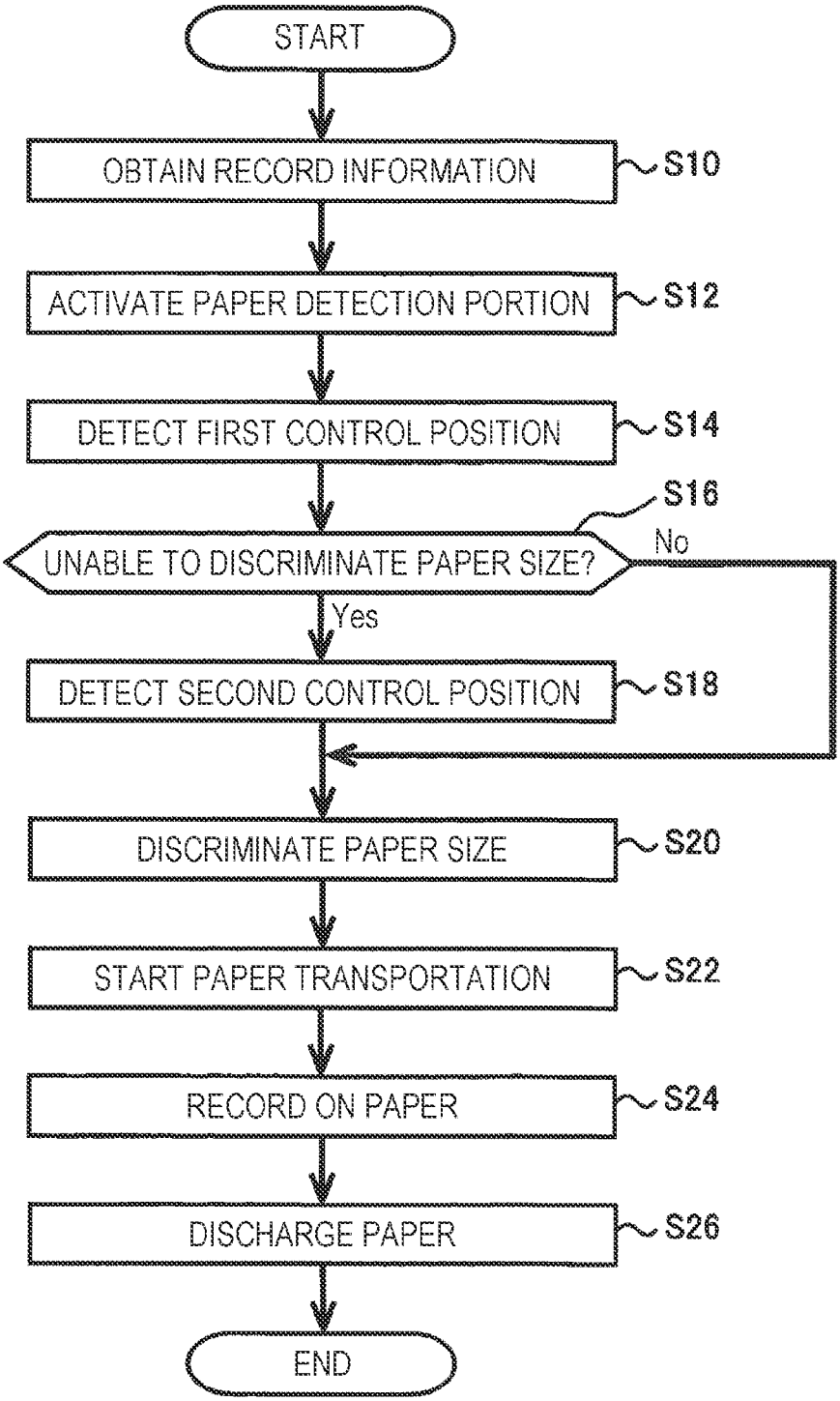
FIG. 13 is a flowchart showing respective procedures with the printer according to the Embodiment 1.

Respective procedures shown in FIG. 13 are implemented by causing the CPU 36 to read the program PR from the memory 38, to load the program PR into a portion of the memory 38, and to execute the program PR. Here, prior to the start of the program PR, the paper P is loaded in the cassette portion 50. The paper P is in the restricted state by the side guide 62 and the end guide 86.

The start of the program PR is assumed to be triggered by input of the record information with the input portion 26 of the printer 10.

In step S10, the CPU 36 obtains the record information. Then, the processing goes to step S12.

In step S12, the CPU 36 activates the paper detection portion 110. Then, the processing goes to step S14.

In step S14, the CPU 36 causes the paper detection portion 110 to detect the first restricting position P1. Specifically, the paper detection portion 110 detects the first restricting position P1 in the X direction of the side guide 62. The detection information on the first restricting position P1 is transmitted to the control portion 34. Then, the processing goes to step S16.

In step S16, the CPU 36 determines whether or not the CPU 36 is unable to discriminate the size of the paper P as an example of the type of the paper P. The processing goes to step S18 when the CPU 36 is unable to discriminate the size of the paper P (S16: yes). The processing goes to step S20 when the CPU 36 is able to discriminate the size of the paper P (S16: no). An example of the case where the CPU 36 is able to discriminate the size of the paper P is the above-mentioned case of the paper PC (FIG. 9).

In step S18, the CPU 36 causes the paper detection portion 110 to detect the second restricting position P2. Specifically, the paper detection portion 110 detects the second restricting position P2 in the Y direction of the end guide 86. The detection information on the second restricting position P2 is transmitted to the control portion 34. Then, the processing goes to step S20.

In step S20, the CPU 36 causes the discrimination portion 40 to discriminate the size of the paper P. Specifically, the discrimination portion 40 discriminates the size of the paper P based on the detection information on the first restricting position P1 and the detection information on the second restricting position P2. Then, the processing goes to step S22.

In step S22, the CPU 36 activates the transporting portion 20 so as to start transporting of the paper P. Then, the processing goes to step S24.

In step S24, the CPU 36 activates the recording portion 30 so as to record on the paper P. Then, the processing goes to step S26.

In step S26, the CPU 36 discharges the paper P to outside of the body portion 12. Then, the CPU 36 terminates the program PR.

As described above, according to the cassette portion 50, the end guide 86 is provided to the side guide 62. For this reason, the paper detection portion 110 can detect the first restricting position P1 in the X direction of the side guide 62 by obtaining the detection information on the detection target portion 89 of the end guide 86.

The detection target portion 89 is formed so as to be capable of obtaining the difference pieces of the detection information in the Y direction. Accordingly, when the paper detection portion 110 detects the detection target portion 89, the paper detection portion 110 can detect what position in the Y direction the end guide 86 is located. In other words, the paper detection portion 110 can detect the second restricting position P2 in the Y direction of the end guide 86.

As described above, the paper detection portion 110 can detect the first restricting position P1 and the second restricting position P2 by detecting the detection target portion 89, and it is therefore unnecessary to secure a space for operating another movable member for detection. As a consequence, it is possible to suppress an increase in size of the cassette portion 50.

According to the cassette portion 50, the paper detection portion 110 directly measures the distance between the paper detection portion 110 and the detection target portion 89. As a consequence, detection accuracy of the first restricting position P1 is improved.

As a comparative example, in a structure provided with a paper detection portion that performs detection by constantly irradiating the entire side surface of the end guide 86 with light, an irradiation range of the light becomes larger than necessary at the time of detection, which leads to poor detection efficiency attributed to wasted energy consumption.

On the other hand, according to the cassette portion 50, the paper detection portion 110 only needs to detect one of the first identification portion 92 and the second identification portion 94. This configuration requires a smaller irradiation range of the light as compared to the comparative example. In this way, it is possible to improve the detection efficiency.

According to the cassette portion 50, the wavelengths of the beams of light used by the light emitting portion 116 are known, so that the first restricting position P1 can be detected by using the magnitude of the light intensity at the light receiving portion 118. One of the identification portions is specified by switching between the beams of light having the different wavelengths in the light emitting portion 116. In other words, either the first identification portion 92 or the second identification portion 94 is specified depending on the difference in reflectance. This makes it possible to detect the second restricting position P2. As described above, since it is only necessary to make the reflectance R1 of the first identification portion 92 different from the reflectance R2 of the second identification portion 94, the first identification portion 92 and the second identification portion 94 are easily manufactured.

According to the cassette portion 50, it is possible to identify the first identification portion 92 or the second identification portion 94 by using the difference in light intensity obtained from the combination of the color of the light used in the light emitting portion 116 with either the color of the first identification portion 92 or the color of the second identification portion 94. Since it is possible to identify the first identification portion 92 or the second identification portion 94 based on the difference between the color of the first identification portion 92 and the color of the second identification portion 94, it is not necessary to carry out processing to change the surface roughness of the first identification portion 92 or the surface roughness of the second identification portion 94 in order to change the reflectance of the first identification portion 92 or the reflectance of the second identification portion 94.

According to the cassette portion 50, the end guide 86 moves while being in contact with the side guide 62. That is to say, the end guide 86 can slide. In other words, the cassette portion 50 can be reduced in size in the X direction since it is possible to bring the distance from the end guide 86 to the side guide 62 closer.

According to the cassette portion 50, a detection range of the detection target portion 89 is narrowed by the window portion 68A. Thus, it is possible to reduce reflected light from a region other than the first identification portion 92 and the second identification portion 94, or in other words, an error factor included in the detection information.

According to the cassette portion 50, the paper P is pinched in the X direction by using the first side guide 64 and the second side guide 72, whereby the paper P is positioned in the X direction. In this way, the paper P is less likely to be displaced in the X direction as compared to a configuration in which the single side guide 62 restricts only the first end portion PX on one side in the X direction. As a consequence, the first restricting position P1 can be detected at high accuracy.

According to the printer 10, the recording portion 30 performs recording on the paper P discriminated by the discrimination portion 40. It is therefore possible to avoid recording on the paper P having a size not targeted for recording.

According to the printer 10, when it is possible to discriminate the size of the paper P based only on the detection information on the first restricting position P1, the size of the paper P is discriminated without using the detection information on the second restricting position P2. Thus, it is possible to reduce time required for discriminating the size of the paper P.

On the other hand, when it is not possible to discriminate the size of the paper P based only on the detection information on the first restricting position P1, the size of the paper P can be discriminated by using the detection information on the second restricting position P2 as well.

According to the printer 10, the paper detection portion 110 is provided to the body portion 12 and is not moved. In other words, even if the cassette body 52 is frequently attached to or detached from the body portion 12, wearing of a terminal serving as an electrical contact of the paper detection portion 110 is reduced. In this way, it is possible to reduce deterioration in transmission of the detection information on the first restricting position P1 and the second restricting position P2.

According to the method of discriminating the paper P of this embodiment, when the discrimination portion 40 can discriminate the size of the paper P based only on the detection information on the first restricting position P1, the discrimination portion 40 does not have to carry out the detection of the second restricting position P2. Thus, it is possible to discriminate the size of the paper P efficiently.

Modified Example of Embodiment 1

In a modified example of the cassette portion 50 of the Embodiment 1, the optical sensor 114 in the paper detection portion 110 may be configured to directly measure the distance in the X direction from the paper detection portion 110 to either the first identification portion 92 or the second identification portion 94. In other words, the optical sensor 114 may be configured to identify the first identification portion 92 or the second identification portion 94 based the change in light intensity at the light receiving portion 118, and to detect the first restricting position P1 based on a time period from a point of time to start light emission from the light emitting portion 116 to a point of time to start light reception at the light receiving portion 118.

According to the modified example of the cassette portion 50, it is possible to directly measure the distance from the paper detection portion 110 to either the first identification portion 92 or the second identification portion 94 based on the time period from the point of time to start light emission from the light emitting portion 116 to the point of time to start light reception at the light receiving portion 118. In this way, the first restricting position P1 can be detected more accurately as compared to the configuration to use the change in light intensity only.

Embodiment 2

Figure 14:
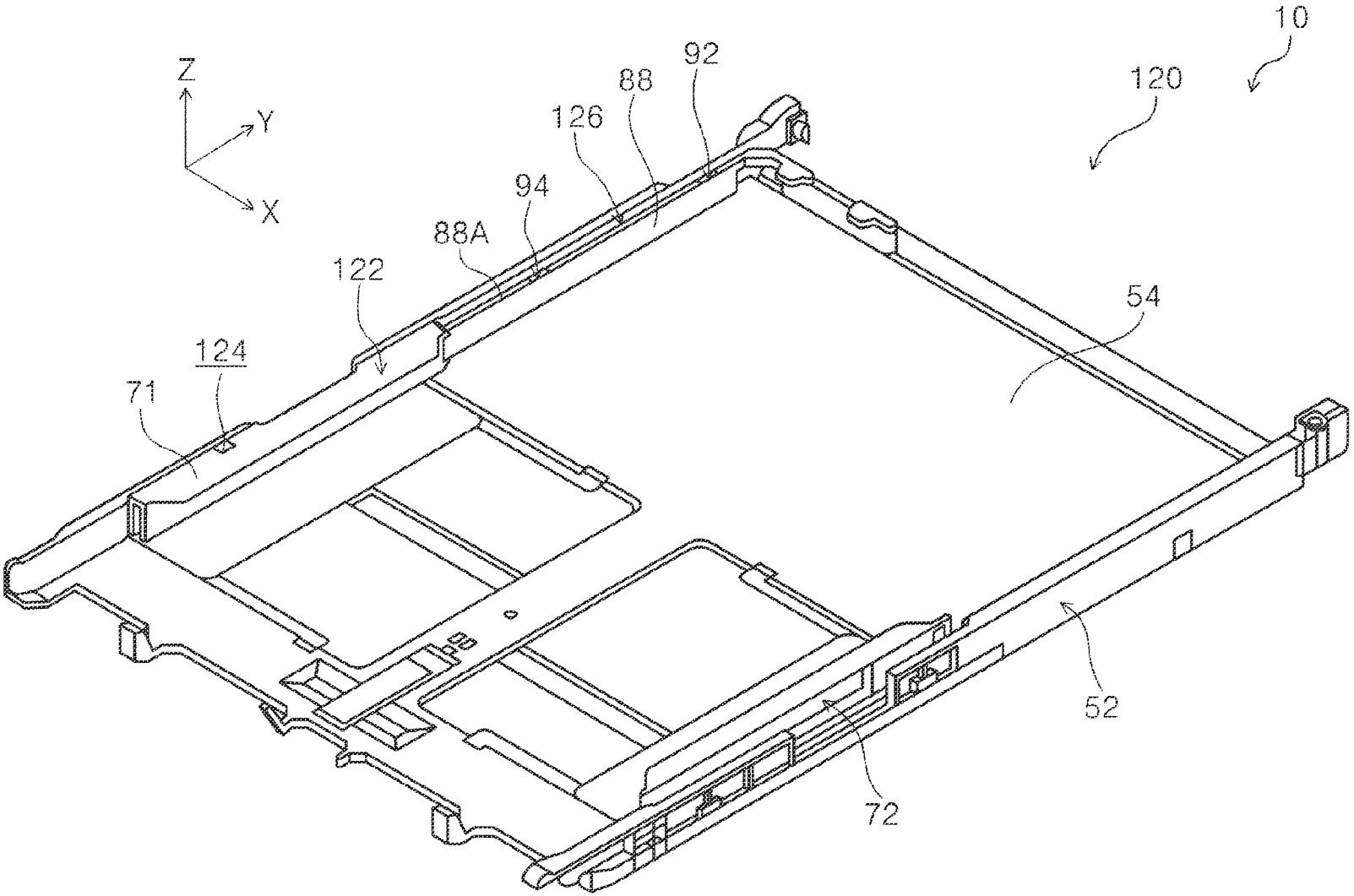
FIG. 14 is a perspective view of a cassette portion in a printer according to an Embodiment 2.
Figure 15:
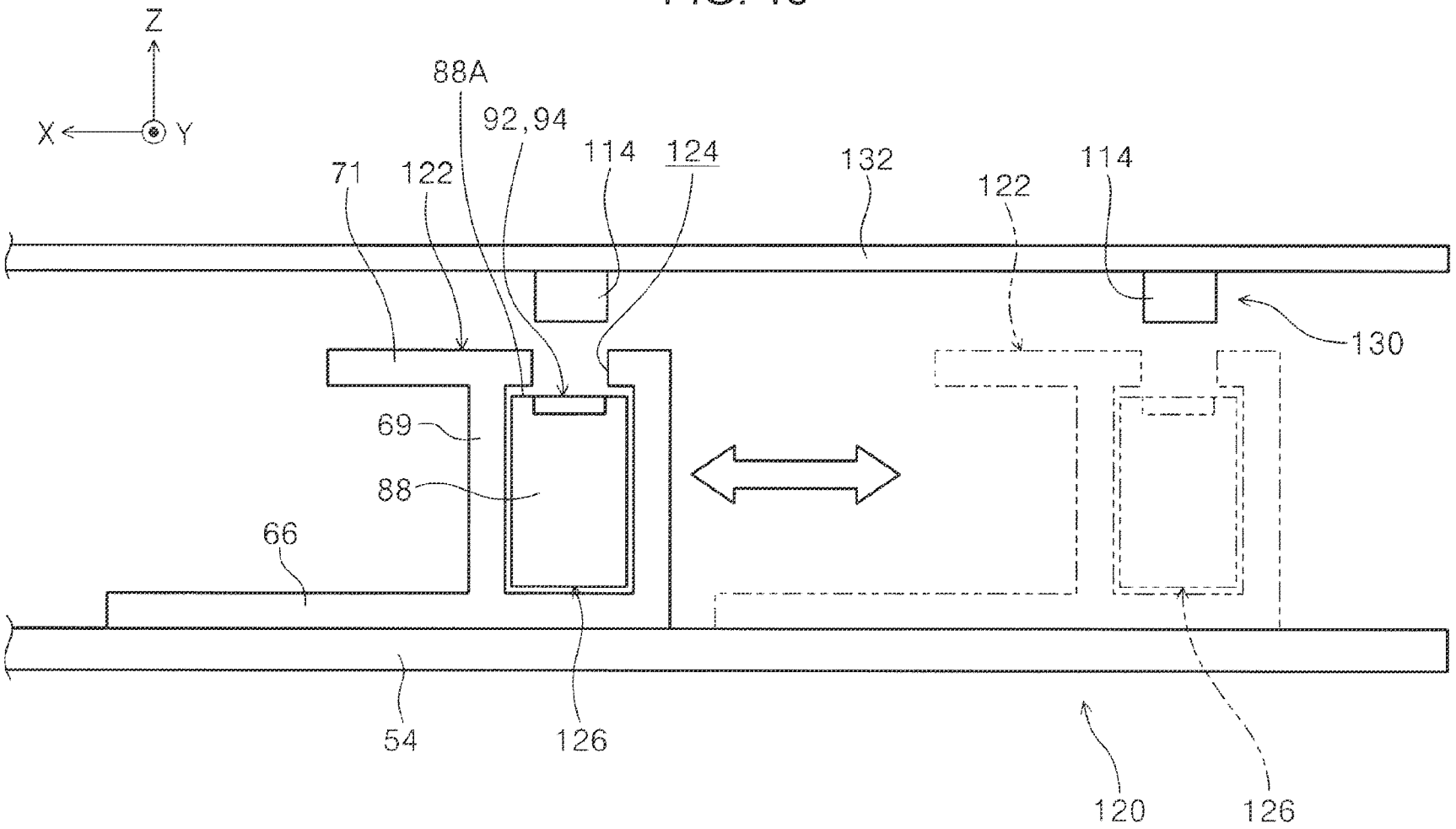
FIG. 15 is a schematic diagram showing a state of detection of a first restricting position and a second restricting position in the printer according to the Embodiment 2.

FIGS. 14 and 15 illustrate a cassette portion 120 in a printer 10 of an Embodiment 2.

The cassette portion 120 represents an example of the medium loading device that loads multiple sheets of the paper P to be transported. Note that the same constituents as those in the cassette portion 50 (FIG. 4) of the Embodiment 1 will be denoted by the same reference signs and explanations thereof will be omitted.

The cassette portion 120 includes a first side guide 122 and an end guide 126 instead of the first side guide 64 and the end guide 86 (FIG. 4) in the cassette portion 50. The cassette portion 120 includes a paper detection portion 130 (FIG. 15) instead of the paper detection portion 110 (FIG. 3).

Configurations other than the first side guide 122, the end guide 126, and the paper detection portion 130 are the same as those in the Embodiment 1.

The first side guide 122 is different from the first side guide 64 (FIG. 5) in that a window portion 124 is formed in the upper wall portion 71 without providing the window portion 68A (FIG. 5). The configurations other than the window portion 124 are the same as those of the first side guide 64.

The window portion 124 penetrates the upper wall portion 71 in the Z direction. The window portion 124 is formed into a quadrangular shape having sides extending in the X direction and the Y direction when viewed in the Z direction. The window portion 124 exposes one of the first identification portion 92 and the second identification portion 94 toward the paper detection portion 130.

The end guide 126 is different from the end guide 86 (FIG. 5) in that first identification portion 92 and the second identification portion 94 are provided on an upper surface 88A in the +Z direction of the vertical wall portion 88. The configurations other than the first identification portion 92 and the second identification portion 94 are the same as those of the end guide 86.

As shown in FIG. 15, the paper detection portion 130 represents an example of the detection portion that detects the first restricting position P1 and the second restricting position P2 (FIG. 9) in the above-mentioned restricted state of the paper P. The paper detection portion 130 is provided to the body portion 12 (FIG. 2) in such a way as to be opposed to in the Z direction to the window portion 124. The paper detection portion 130 detects the first restricting position P1 and the second restricting position P2 by obtaining the detection information on the first identification portion 92 or the second identification portion 94.

The paper detection portion 130 includes a substrate 132 and multiple optical sensors 114. The substrate 132 is attached to the body portion 12 and extends in the X direction.

The optical sensors 114 are provided on the substrate 132 at given intervals in the X direction. Positions of the optical sensors 114 are set in accordance with the sizes of the paper P that can be stored in the cassette portion 120.

Next, an operation of the cassette portion 120 of the Embodiment 2 will be described.

In the cassette portion 120, the paper detection portion 130 measures light intensities of the light received by the optical sensors 114, and detects the first restricting position P1 of the first side guide 122 by determining which one of the optical sensors 114 is opposed in the Z direction to the first identification portion 92 or the second identification portion 94. For example, when the light intensity obtained with one of the two optical sensors 114 is small and the light intensity obtained with the other optical sensor 114 is large, it is apparent that the first identification portion 92 or the second identification portion 94 is located at the position opposed to the latter optical sensor 114.

The paper detection portion 130 detects the second restricting position P2 of the end guide 126 by changing the color of the light as described earlier and determining which one of the first identification portion 92 and the second identification portion 94 is opposed to the paper detection portion 130.

As mentioned above, the paper detection portion 130 may be opposed in the Z direction to the first identification portion 92 and the second identification portion 94.

Embodiment 3

Figure 16:
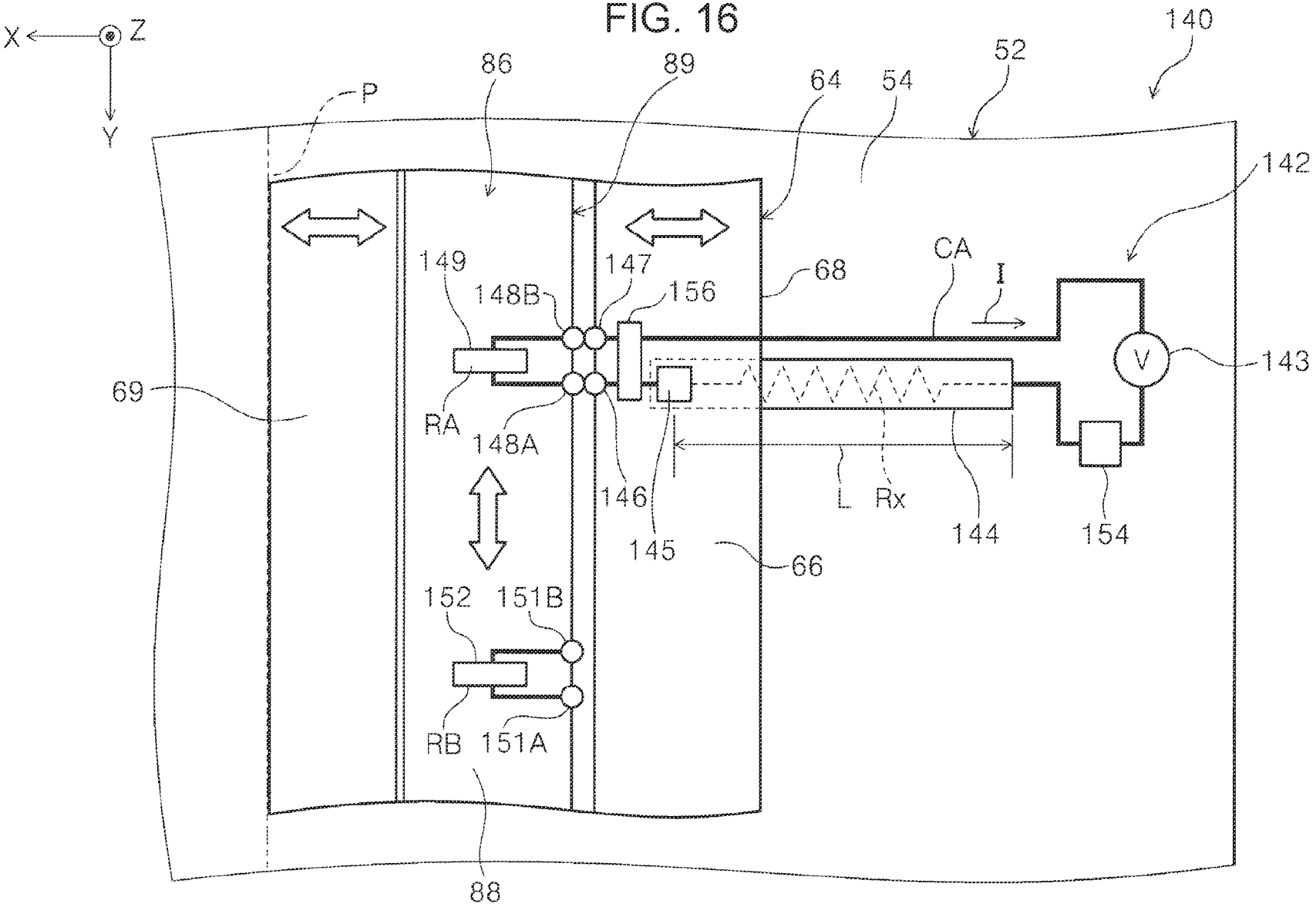
FIG. 16 is a schematic diagram showing a detection structure for a first restricting position and a second restricting position in a printer according to an Embodiment 3.

FIG. 16 illustrates a cassette portion 140 in a printer 10 of an Embodiment 3.

The cassette portion 140 represents an example of the medium loading device that loads multiple sheets of the paper P to be transported. Note that the same constituents as those in the cassette portion 50 (FIG. 4) of the Embodiment 1 will be denoted by the same reference signs and explanations thereof will be omitted.

The cassette portion 140 includes a paper detection portion 142 instead of the paper detection portion 110 (FIG. 3) in the cassette portion 50 (FIG. 4). Configurations other than the paper detection portion 142 are the same as those in the Embodiment 1.

The paper detection portion 142 represents an example of the detection portion that detects the first restricting position P1 and the second restricting position P2 (FIG. 9) in the above-mentioned restricted state. The paper detection portion 142 includes a power supply 143, a metal plate 144, a sliding plate 145, detection terminals 146 and 147, first terminals 148A and 148B, a first resistor 149, second terminals 151A and 151B, a second resistor 152, a current measurement portion 154, and a switch 156. In the meantime, a circuit CA is formed in the paper detection portion 142.

The power supply 143 is provided to the body portion 12 (FIG. 2), and it coupled to a portion of the circuit CA through a not-illustrated contact point, for example. A voltage V supplied from the power supply 143 to the circuit CA is defined as V1 [V].

The metal plate 144 is formed from a copper plate, for example. The metal plate 144 has a predetermined thickness in the Z direction and extends in the X direction. The metal plate 144 is provided to the bottom wall 54 of the cassette body 52. A surface in the +Z direction of the metal plate 144 is exposed.

The sliding plate 145 is formed from a copper plate and is provided to the bottom wall portion 66 of the first side guide 64, for example. The sliding plate 145 is in contact with the metal plate 144. Then, the sliding plate 145 slides on the metal plate 144 in accordance with the motion in the X direction of the first side guide 64.

Here, in a case of a change in distance L [mm] from an end in the −X direction of the metal plate 144 to a central position of the sliding plate 145, a resistance value Rx [Ω] varies in accordance with the distance L [mm]. In other words, the metal plate 144 and the sliding plate 145 form variable resistance of the resistance value Rx.

The detection terminals 146 and 147 are exposed from an end surface in the +X direction of the outer wall portion 68, respectively. The detection terminal 146 is electrically coupled to the sliding plate 145. The detection terminal 147 is electrically coupled to the power supply 143.

The first terminals 148A and 148B are exposed from an end surface in the −X direction of the vertical wall portion 88, respectively. The circuit CA forms a closed circuit when the first terminal 148A is brought into contact with the detection terminal 146 and the first terminal 148B is brought into contact with the detection terminal 147.

The first resistor 149 is provided to the vertical wall portion 88 and electrically couples the first terminal 148A to the first terminal 148B. A resistance value of the first resistor 149 is defined as RA [Ω].

The second terminals 151A and 151B are located in the +Y direction relative to the first terminal 148A, for example. The second terminals 151A and 151B are exposed from an end surface in the −X direction of the vertical wall portion 88, respectively. The circuit CA forms a closed circuit when the second terminal 151A is brought into contact with the detection terminal 146 and the second terminal 151B is brought into contact with the detection terminal 147.

The second resistor 152 is provided to the vertical wall portion 88 and electrically couples the second terminal 151A to the second terminal 151B. A resistance value of the second resistor 152 is defined as RB [Ω].

As described above, the detection target portion 89 includes the first resistor 149 and the second resistor 152.

The current measurement portion 154 measures a current I [A] flowing in the circuit CA.

The switch 156 is provided so as to be able to switch between a first state where the circuit CA does not include the first resistor 149 or the second resistor 152 and a second state where the circuit CA includes the first resistor 149 and the second resistor 152.

In the following description, respective resistance values at a point of contact of the metal plate 144 with the sliding plate 145, points of contact of the detection terminals 146 and 147 with the first terminals 148A and 148B, and points of contact of the detection terminals 146 and 147 with the second terminals 151A and 151B as well as an internal resistance value of the current measurement portion 154 in the state of the closed circuit of the circuit CA are assumed to be included in a calculated value of electric resistance of the circuit CA.

Next, an operation of the cassette portion 140 of the Embodiment 3 will be described.

FIG. 16 shows a state where the detection terminal 146 is in contact with the first terminal 148A and the detection terminal 147 is in contact with the first terminal 148B, for example. Here, at a point of time before starting the detection by the paper detection portion 142, it is unknown what are in contact with the detection terminals 146 and 147. The switch 156 is assumed to be set to the first state at the point of start of detection.

Here, when the current I=IA is measured with the current measurement portion 154, the resistance value Rx=V1/IA is obtained. Since the resistance value Rx varies with a distance L1, the distance L1 is derived from the obtained resistance value Rx. In other words, the first restricting position P1 is detected by the paper detection portion 142.

Subsequently, the switch 156 is switched to the second state. Here, when a current IB is measured with the current measurement portion 154, a resistance value is obtained as R=(V1/IB)−Rx=RA. Accordingly, it turns out that the circuit CA includes the first resistor 149. In other words, the paper detection portion 142 detects the second restricting position P2 corresponding to the first resistor 149.

Here, when the obtained resistance value R is equal to RB, the second restricting position P2 corresponding to the second resistor 152 is detected.

As described above, the cassette portion 140 can detect the first restricting position P1 and the second restricting position P2 by causing the paper detection portion 142 to detect the detection target portion 89 based on the resistance value R of the circuit CA. Thus, it is unnecessary to secure a space for operating another movable member for detection. As a consequence, it is possible to suppress an increase in size of the cassette portion 140.

Other Embodiments

Although each of the Embodiments 1 to 3 as well as the modified example of the Embodiment 1 is based on the relevant configuration described above, it is of course possible to modify or omit the configurations in part within a range not departing from the scope of the present disclosure.

Figure 17:
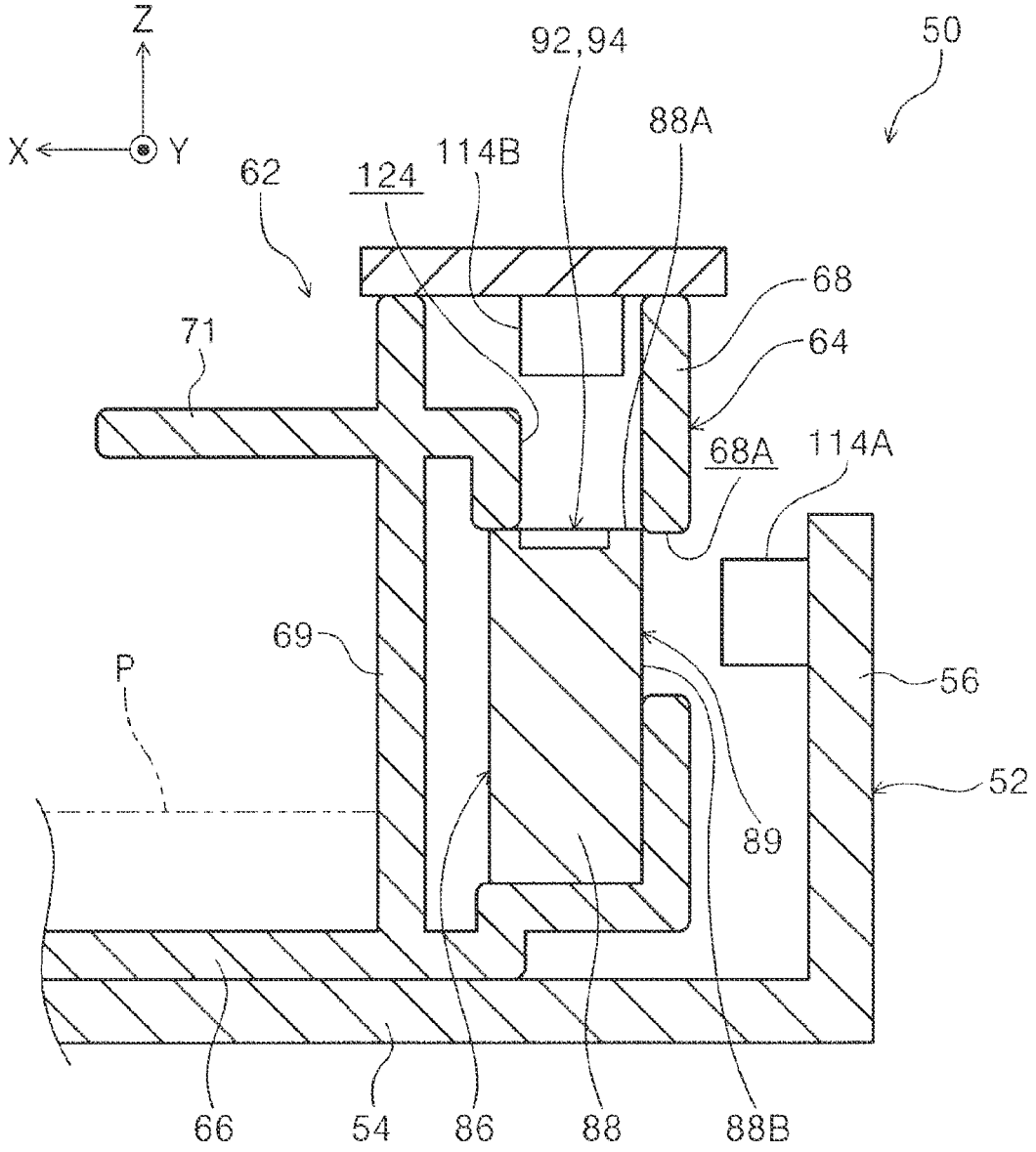
FIG. 17 is a sectional view showing a structure of a detection portion in a printer according to a modified example.

As shown in FIG. 17, as another modified example of the cassette portion 50, the first side guide 64 may be provided with the window portion 68A and the window portion 124, and an optical sensor 114A opposed in the X direction to the window portion 68A and an optical sensor 114B opposed in the Z direction to the window portion 124 may be provided.

The optical sensor 114A is attached to a side surface in the +X direction of the side wall 56.

The optical sensor 114B is attached to the first side guide 64. In other words, a portion of the paper detection portion 110 is provided to the side guide 62 instead of the body portion 12 (FIG. 2).

The detection target portion 89 of the end guide 86 includes a side surface 88B in the −X direction of the vertical wall portion 88, and the first identification portion 92 as well as the second identification portion 94 provided to the upper surface 88A. The side surface 88B has a property to reflect the light.

Here, the first restricting position P1 is detected by measuring a distance in the X direction from the optical sensor 114A to the side surface 88B. The second restricting position P2 is detected by causing the optical sensor 114B to detect the first identification portion 92 or the second identification portion 94. As described above, detection of the first restricting position P1 and the second restricting position P2 may be carried out by detecting the detection target portion 89 of the end guide 86 in the X direction and the Z direction.

In the cassette portion 50, the number of the identification portions is not limited to two of the first identification portion 92 and the second identification portion 94, and three or more identification portions may be provided instead. The colors of the light from the light emitting portion 116 are not limited only to the two colors of red and green, and there may be three or more colors. Alternatively, colors other than red and green may be used as the colors of the light from the light emitting portion 116.

A single detection target portion 89 and a single detection target surface may be used instead of using the multiple identification portions, and the second restricting position P2 may be detected either continuously or stepwise by changing the surface roughness or the shape of this detection target surface, for instance. In the case of changing the surface roughness of the detection target surface, the detection target surface may be provided with an irregular portion having a trapezoidal sectional shape or an irregular portion having a shape formed by arranging multiple circular truncated cones.

The light intensities of the identification portions to be received by the light receiving portion 118 may be varied by changing the areas of the surfaces to reflect the light without changing the reflectances thereof.

One of the first identification portion 92 and the second identification portion 94 may be formed by using a side surface of the detection target portion 89 and the other one may be provided to the side surface in the form of a separate component.

In the cassette portion 50, the detection target portion 89 does not have to come into contact in the X direction with the support portion 65. The support portion 65 does not have to be provided with the window portion 68A. For example, in a structure not provided with the outer wall portion 68, the end guide 86 may be guided by a guide rail provided to the inner wall portion 69. In other words, it is possible to detect the positions in the X direction and the Y direction of the end guide 86 and of the side guide 62 even in the case of a configuration to support the end guide 86 on an outer side in the X direction of the side guide 62.

The configuration of the side guide 62 is not limited only to the configuration to interlock the first side guide 64 and the second side guide 72 with each other. The side guide 62 may adopt a one-sided structure that uses a single side guide.

The discrimination portion 40 may be configured to always use the detection information on the first restricting position P1 and the detection information on the second restricting position P2.

Here, among structures of respective modified examples of the cassette portion 50, structures provided to the cassette portion 120 and the cassette portion 140 may apply the structure of the modified example as with the cassette portion 50.

The paper detection portions 110, 130, and 142 are not limited only to those provided with the reflective optical sensors 114, but may include transmissive optical sensors. In the case of this structure, each of the detection target portion and the identification portions is formed from a transparent or translucent member that transmits the light. Here, the sizes of the sheets of paper P may be discriminated by changing transmission levels of the light through the translucent members, or in other words, by allowing the optical sensors to output the light at multiple intermediate values.

The respective structures of the side guide 62, the end guide 86, and the paper detection portions 110, 130, and 142 may be used in a portion to load originals in an image reading apparatus configured to read the originals. Such an original represents an example of the medium. The respective structures mentioned above may be used in a portion to load the sheets of paper P in the second feed route T2. The respective structures mentioned above may be used in a loading portion on a manual feeding route for the sheets of paper P. This manual feeding route is a straight route extending in the Y direction, which is the route joined to the common route T3, for example.

What is claimed is:

1. A medium loading device to load a plurality of media to be transported, comprising:

a side guide configured to move in a width direction intersecting a transport direction of one of the media and to restrict a motion of a first end portion in the width direction of the medium;

an end guide provided to the side guide in such a way as to move in the transport direction and to restrict a motion of a second end portion in the transport direction of the medium; and a detection portion that detects a first restricting position in the width direction of the side guide and a second restricting position in the transport direction of the end guide in a restricted state where the side guide and the end guide restrict a motion of the medium, wherein the end guide includes a detection target portion formed such that detection information to be detected by the detection portion varies in the transport direction, the detection portion detects the first restricting position and the second restricting position by obtaining the detection information on the detection target portion, and the detection portion detects the first restricting position by measuring a distance between the detection portion and the detection target portion.

2. The medium loading device according to claim 1, wherein the detection target portion includes a plurality of identification portions being arranged in the transport direction and having the detection information different from each other, and the detection portion detects the second restricting position by identifying one of the identification portions.

3. The medium loading device according to claim 2, wherein the detection portion includes an optical sensor provided with a light emitting portion configured to switch between beams of light having different wavelengths and to emit the light toward the identification portions, and a light receiving portion that receives the light reflected from the identification portions, the identification portions have reflectances different from each other, and the detection portion identifies, based on a change in light intensity at the light receiving portion when the light emitting portion switches between the beams of the light having the different wavelengths, a reflectance of one of the identification portions, the reflectance being one of the reflectances different from each other, and detects the second restricting position.

4. The medium loading device according to claim 3, wherein colors of the identification portions are different from each other.

5. The medium loading device according to claim 2, wherein the detection portion includes an optical sensor provided with a light emitting portion that emits light toward the identification portions, and a light receiving portion that receives the light reflected from the identification portions, and the optical sensor identifies, based on a change in light intensity at the light receiving portion, one of the identification portions, and detects, based on a time period from a point of time to start light emission from the light emitting portion to a point of time to start light reception at the light receiving portion, the first restricting position.

6. The medium loading device according to claim 1, wherein a support portion that supports a portion of the end guide is provided to the side guide, and the detection target portion is configured to come into contact in the width direction with the support portion.

7. The medium loading device according to claim 6, wherein the support portion includes a window portion that exposes a portion of the detection target portion toward the detection portion.

8. The medium loading device according to claim 1, wherein the side guide includes a first side guide that supports the end guide, a second side guide provided on an opposite side of a side on which the detection portion is located relative to the first side guide, and configured to come into contact with the medium, and an interlocking portion that interlocks the first side guide and the second side guide in mutually opposite directions in the width direction.

9. A recording apparatus comprising:

the medium loading device according to claim 1;

a discrimination portion that discriminates, based on a result of detection of the first restricting position and the second restricting position by the detection portion, a type of the medium loaded in the medium loading device;

a transporting portion that transports the medium that is discriminated; and a recording portion that performs recording on the medium that is transported.

10. The recording apparatus according to claim 9, wherein the discrimination portion discriminates, based on detection information on the first restricting position, the type of the medium, and when the discrimination portion fails to discriminate the type of the medium based on the detection information on the first restricting position, discriminates, based on detection information on the second restricting position, the type of the medium.

11. The recording apparatus according to claim 9, further comprising:

an apparatus body that houses the recording portion, wherein the medium loading device includes a storage portion detachably provided to the apparatus body and configured to store the medium, the side guide and the end guide are provided to the storage portion, and the detection portion is provided to the apparatus body.

12. A medium discrimination method in the medium loading device according to claim 1, comprising:

detecting the first restricting position in the width direction of the side guide;

determining whether or not a type of the medium is discriminable based on information on the first restricting position;

detecting, when the type of the medium is not discriminable, the second restricting position in the transport direction of the end guide; and discriminating, based on information on the first restricting position only or based on information on the first restricting position and the second restricting position, the type of the medium.

13. A medium loading device to load a plurality of media to be transported, comprising:

a side guide configured to move in a width direction intersecting a transport direction of one of the media and to restrict a motion of a first end portion in the width direction of the medium;

an end guide provided to the side guide in such a way as to move in the transport direction and to restrict a motion of a second end portion in the transport direction of the medium; and a detection portion that detects a first restricting position in the width direction of the side guide and a second restricting position in the transport direction of the end guide in a restricted state where the side guide and the end guide restrict a motion of the medium, wherein the end guide includes a detection target portion formed such that detection information to be detected by the detection portion varies in the transport direction, the detection portion detects the first restricting position and the second restricting position by obtaining the detection information on the detection target portion, and the detection portion includes an optical sensor provided with a light emitting portion configured to switch between beams of light having different wavelengths and a light receiving portion that receives reflected light.

14. The medium loading device according to claim 13, wherein the detection portion detects the first restricting position by measuring a distance between the detection portion and the detection target portion.

15. A recording apparatus comprising:

a medium loading device to load a plurality of media to be transported, comprising:

a side guide configured to move in a width direction intersecting a transport direction of one of the media and to restrict a motion of a first end portion in the width direction of the medium;

an end guide provided to the side guide in such a way as to move in the transport direction and to restrict a motion of a second end portion in the transport direction of the medium; and a detection portion that detects a first restricting position in the width direction of the side guide and a second restricting position in the transport direction of the end guide in a restricted state where the side guide and the end guide restrict a motion of the medium;

a discrimination portion that discriminates, based on a result of detection of the first restricting position and the second restricting position by the detection portion, a type of the medium loaded in the medium loading device;

a transporting portion that transports the medium that is discriminated; and a recording portion that performs recording on the medium that is transported, wherein the end guide includes a detection target portion formed such that detection information to be detected by the detection portion varies in the transport direction, the detection portion detects the first restricting position and the second restricting position by obtaining the detection information on the detection target portion, the discrimination portion discriminates, based on detection information on the first restricting position, the type of the medium, and when the discrimination portion fails to discriminate the type of the medium based on the detection information on the first restricting position, discriminates, based on detection information on the second restricting position, the type of the medium.

* * * * *